US009074431B2

(12) United States Patent
Portwood et al.

(10) Patent No.: US 9,074,431 B2
(45) Date of Patent: Jul. 7, 2015

(54) ROLLING CONE DRILL BIT HAVING HIGH DENSITY CUTTING ELEMENTS

(75) Inventors: Gary Portwood, Florence (IT); Luca Tedeschi, Volterra (IT); Giampaolo Ferrari, Santi Stefano di Nagra (IT); Josh Gatell, Cypress, TX (US); John Clunan, Tyler, TX (US); Allen D. White, Houston, TX (US)

(73) Assignee: Smith International, Inc., Houston, TX (US)

( * ) Notice: Subject to any disclaimer, the term of this patent is extended or adjusted under 35 U.S.C. 154(b) by 1123 days.

(21) Appl. No.: 12/351,188

(22) Filed: Jan. 9, 2009

(65) Prior Publication Data

US 2009/0188724 A1 Jul. 30, 2009

Related U.S. Application Data

(60) Provisional application No. 61/020,612, filed on Jan. 24, 2008, provisional application No. 61/024,129, filed on Jan. 28, 2008.

(51) Int. Cl.
*E21B 10/16* (2006.01)

(52) U.S. Cl.
CPC ..... *E21B 10/16* (2013.01)

(58) Field of Classification Search
CPC ... E21B 10/08; E21B 10/16; E21B 2010/425; E21B 10/43
USPC ..... 175/327, 331, 378, 341, 377
See application file for complete search history.

(56) References Cited

U.S. PATENT DOCUMENTS

| | | | | | |
|---|---|---|---|---|---|
| 1,871,736 | A | * | 8/1932 | Reed | 175/340 |
| 2,990,025 | A | * | 6/1961 | Talbert et al. | 175/375 |
| 4,209,684 | A | * | 6/1980 | Evans | 219/121.35 |
| 4,420,050 | A | | 12/1983 | Jones | |
| 4,657,093 | A | * | 4/1987 | Schumacher | 175/353 |
| 4,763,736 | A | * | 8/1988 | Varel, Sr. | 175/341 |
| 4,940,099 | A | * | 7/1990 | Deane et al. | 175/374 |
| 4,984,643 | A | * | 1/1991 | Isbell et al. | 175/341 |
| 5,224,560 | A | * | 7/1993 | Fernandez | 175/374 |

(Continued)

FOREIGN PATENT DOCUMENTS

| | | |
|---|---|---|
| GB | 2327962 | 2/1999 |
| GB | 2362905 | 12/2001 |

(Continued)

OTHER PUBLICATIONS

Response to Examination Report dated May 15, 2009 for Appl. No. GB0900409.4; (24 p.).

(Continued)

*Primary Examiner* — Brad Harcourt
(74) *Attorney, Agent, or Firm* — Christie, Parker & Hale, LLP

(57) ABSTRACT

A rolling cone drill bit for drilling in earthen formations having a plurality of rolling cone cutters. Each cone cutter includes a plurality of gage cutting elements, a first plurality of bottomhole cutting elements, and a second plurality of bottomhole cutter elements. Each of the first plurality of bottomhole cutting elements is staggered relative to the gage cutting elements on each cone cutter. Each of the second plurality of bottomhole cutting elements is staggered relative to the first plurality of bottomhole cutting elements on at least one cone cutter.

23 Claims, 25 Drawing Sheets

(56) References Cited

U.S. PATENT DOCUMENTS

| | | | | |
|---|---|---|---|---|
| 5,346,026 | A * | 9/1994 | Pessier et al. | 175/331 |
| 5,353,885 | A * | 10/1994 | Hooper et al. | 175/378 |
| 5,547,033 | A * | 8/1996 | Campos, Jr. | 175/331 |
| 5,636,700 | A * | 6/1997 | Shamburger, Jr. | 175/331 |
| 5,671,817 | A * | 9/1997 | Smith et al. | 175/374 |
| 5,695,018 | A * | 12/1997 | Pessier et al. | 175/331 |
| 5,833,020 | A | 11/1998 | Portwood et al. | |
| 5,839,526 | A * | 11/1998 | Cisneros et al. | 175/431 |
| 5,967,245 | A * | 10/1999 | Garcia et al. | 175/374 |
| 6,095,264 | A * | 8/2000 | Dillard | 175/331 |
| 6,196,338 | B1 * | 3/2001 | Slaughter et al. | 175/331 |
| 6,209,668 | B1 * | 4/2001 | Pessier et al. | 175/371 |
| 6,250,407 | B1 * | 6/2001 | Karlsson | 175/371 |
| 6,390,210 | B1 | 5/2002 | Portwood et al. | |
| 6,443,246 | B1 * | 9/2002 | Pessier et al. | 175/378 |
| 6,484,824 | B2 * | 11/2002 | Skyles | 175/341 |
| 6,510,909 | B2 * | 1/2003 | Portwood et al. | 175/331 |
| 6,527,068 | B1 * | 3/2003 | Singh et al. | 175/431 |
| 6,561,292 | B1 * | 5/2003 | Portwood | 175/376 |
| 6,595,304 | B2 * | 7/2003 | Chen | 175/378 |
| 6,598,689 | B1 * | 7/2003 | Slaughter et al. | 175/331 |
| 6,601,661 | B2 * | 8/2003 | Baker et al. | 175/341 |
| 6,604,587 | B1 * | 8/2003 | Huang et al. | 175/331 |
| 6,612,384 | B1 * | 9/2003 | Singh et al. | 175/341 |
| 6,640,913 | B2 * | 11/2003 | Lockstedt et al. | 175/331 |
| 6,651,758 | B2 * | 11/2003 | Xiang et al. | 175/431 |
| 6,827,161 | B2 * | 12/2004 | Singh et al. | 175/374 |
| 6,848,521 | B2 * | 2/2005 | Lockstedt et al. | 175/431 |
| 6,942,045 | B2 * | 9/2005 | Dennis | 175/378 |
| 6,988,569 | B2 * | 1/2006 | Lockstedt et al. | 175/331 |
| 7,040,424 | B2 * | 5/2006 | Yong et al. | 175/374 |
| 7,124,842 | B2 * | 10/2006 | Lockstedt et al. | 175/374 |
| 7,234,549 | B2 * | 6/2007 | McDonough et al. | 175/378 |
| 7,258,175 | B2 * | 8/2007 | Veeningen et al. | 175/40 |
| 7,331,410 | B2 * | 2/2008 | Yong et al. | 175/331 |
| 7,367,413 | B2 * | 5/2008 | Lockstedt et al. | 175/331 |
| 7,370,711 | B2 * | 5/2008 | Singh | 175/77 |
| 7,631,709 | B2 * | 12/2009 | McDonough et al. | 175/430 |
| 7,686,104 | B2 * | 3/2010 | Singh et al. | 175/341 |
| 7,699,126 | B2 * | 4/2010 | Boudrare et al. | 175/374 |
| 7,749,947 | B2 * | 7/2010 | Griffo et al. | 508/150 |
| 7,779,936 | B2 * | 8/2010 | Felderhoff et al. | 175/331 |
| 7,913,778 | B2 * | 3/2011 | Tedeschi et al. | 175/339 |
| 2001/0004026 | A1 * | 6/2001 | Lockstedt et al. | 175/431 |
| 2001/0027881 | A1 * | 10/2001 | Steinke et al. | 175/374 |
| 2002/0000335 | A1 * | 1/2002 | Chen | 175/374 |
| 2002/0017401 | A1 * | 2/2002 | Xiang et al. | 175/331 |
| 2002/0023783 | A1 * | 2/2002 | Skyles | 175/371 |
| 2002/0070053 | A1 * | 6/2002 | Siracki | 175/374 |
| 2002/0079138 | A1 * | 6/2002 | Xiang | 175/331 |
| 2002/0153171 | A1 * | 10/2002 | Portwood et al. | 175/331 |
| 2003/0051922 | A1 * | 3/2003 | Baker et al. | 175/374 |
| 2003/0136588 | A1 * | 7/2003 | Truax et al. | 175/376 |
| 2003/0188896 | A1 * | 10/2003 | Minikus et al. | 175/374 |
| 2004/0045743 | A1 * | 3/2004 | Lockstedt et al. | 175/374 |
| 2004/0251053 | A1 * | 12/2004 | McDonough et al. | 175/378 |
| 2005/0051361 | A1 * | 3/2005 | Singh et al. | 175/40 |
| 2005/0167161 | A1 * | 8/2005 | Aaron et al. | 175/331 |
| 2005/0167162 | A1 * | 8/2005 | Lockstedt et al. | 175/431 |
| 2005/0194191 | A1 * | 9/2005 | Chen et al. | 175/426 |
| 2005/0217899 | A1 * | 10/2005 | Hossain et al. | 175/340 |
| 2005/0236184 | A1 * | 10/2005 | Veeningen et al. | 175/40 |
| 2006/0006003 | A1 * | 1/2006 | Singh et al. | 175/57 |
| 2006/0027403 | A1 * | 2/2006 | Lockstedt et al. | 175/374 |
| 2006/0074616 | A1 * | 4/2006 | Chen | 703/10 |
| 2006/0219442 | A1 * | 10/2006 | Felderhoff et al. | 175/331 |
| 2006/0237235 | A1 * | 10/2006 | Richman | 175/331 |
| 2006/0260846 | A1 * | 11/2006 | Portwood et al. | 175/331 |
| 2006/0260847 | A1 * | 11/2006 | Lockstedt et al. | 175/331 |
| 2007/0034411 | A1 * | 2/2007 | Singh | 175/77 |
| 2007/0034414 | A1 * | 2/2007 | Singh et al. | 175/374 |
| 2007/0187149 | A1 * | 8/2007 | Kristensen et al. | 175/57 |
| 2008/0201115 | A1 * | 8/2008 | Singh et al. | 703/1 |
| 2008/0245576 | A1 * | 10/2008 | Liang et al. | 175/374 |
| 2009/0065261 | A1 * | 3/2009 | Lockstedt et al. | 175/350 |
| 2009/0095536 | A1 * | 4/2009 | Tedeschi et al. | 175/340 |

FOREIGN PATENT DOCUMENTS

| | | |
|---|---|---|
| GB | 2378465 | 2/2003 |
| GB | 2399373 | 9/2004 |
| GB | 2429221 | 2/2007 |
| GB | 2442232 | 4/2008 |

OTHER PUBLICATIONS

UK Examination Report dated Mar. 1, 2010 for Appl. No. GB0900409.4; (2 p.).

Response to Examination Report dated Mar. 1, 2010 for Appl. No. GB0900409.4; (17 p.).

Combined Search and Examination Report for Appl. No. GB0900409.4 dated May 14, 2009; (4 p.).

Combined Search and Examination Report for Appl. No. GB1000181.6 dated Jan. 20, 2010; (5 p.).

* cited by examiner

| IADC BIT CLASSIFICATION SYSTEM<br>BIT FORMATION SERIES & TYPES | | |
|---|---|---|
| MILLED TOOTH BITS | | |
| SERIES | FORMATION | TYPES |
| 1 | SOFT FORMATION / LOW COMPRESSIVE STRENGTH | 1 |
| | | 2 |
| | | 3 |
| 2 | MEDIUM TO MADIUM-HARD FORMATIONS / HIGH COMPRESSIVE STRENGTH | 1 |
| | | 2 |
| | | 3 |
| 3 | HARD, SEMI-ABRASIVE FORMATIONS | 1 |
| | | 2 |
| | | 3 |
| TCI BITS | | |
| SERIES | FORMATION | TYPES |
| 4 | SOFT FORMATION / LOW COMPRESSIVE STRENGTH | 1 |
| | | 2 |
| | | 3 |
| | | 4 |
| 5 | SOFT TO MEDIUM-HARD FORMATIONS / LOW-COMPRESSIVE STRENGTH | 1 |
| | | 2 |
| | | 3 |
| | | 4 |
| 6 | MEDIUM-HARD FORMATIONS / HIGH-COMPRESSIVE STRENGTH | 1 |
| | | 2 |
| | | 3 |
| | | 4 |
| 7 | HARD, SEMI-ABRASIVE AND ABRASIVE FORMATIONS | 1 |
| | | 2 |
| | | 3 |
| | | 4 |
| 8 | EXTREMELY HARD AND ABRASIVE FORMATIONS | 1 |
| | | 2 |
| | | 3 |
| | | 4 |

*Fig. 9*

ROLLING CONE DRILL BIT HAVING HIGH DENSITY CUTTING ELEMENTS

CROSS-REFERENCE TO RELATED APPLICATIONS

This application claims benefit of U.S. Provisional Application Ser. No. 61/020,612, filed on Jan. 24, 2008 and entitled "Rolling Cone Drill Bit Having High Density," and U.S. Provisional Application Ser. No. 61/024,129, filed on Jan. 28, 2008 and entitled "Rolling Cone Drill Bit Having High Density," each of which are hereby incorporated herein by reference in their entirety for all purposes.

STATEMENT REGARDING FEDERALLY SPONSORED RESEARCH OR DEVELOPMENT

Not Applicable.

BACKGROUND

1. Field of the Invention

The invention relates generally to earth-boring bits used to drill a borehole for the ultimate recovery of oil, gas or minerals. More particularly, the invention relates to rolling cone rock bits and to an improved cutting structure for such bits. Still more particularly, the invention relates to enhancements in cutting element placement so as to decrease the likelihood of bit tracking.

2. Background of the Technology

An earth-boring drill bit is typically mounted on the lower end of a drill string and is rotated by rotating the drill string at the surface, actuation of downhole motors or turbines, or both. With weight applied to the drill string, the rotating drill bit engages the earthen formation and proceeds to form a borehole along a predetermined path toward a target zone. The borehole thus created will have a diameter generally equal to the diameter or "gage" of the drill bit.

An earth-boring bit in common use today includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones or rolling cone cutters. The borehole is formed as the action of the rotary cones remove chips of formation material that are carried upward and out of the borehole by drilling fluid which is pumped downwardly through the drill pipe and out of the bit.

The earth disintegrating action of the rolling cone cutters is enhanced by providing a plurality of cutting elements on the cutters. Cutting elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are known as "steel tooth bits." In each instance, the cutting elements on the rotating cutters break up the formation to form the new borehole by a combination of gouging and scraping or chipping and crushing.

In oil and gas drilling, the cost of drilling a borehole is very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer, and which are usable over a wider range of formation hardness.

The length of time that a drill bit may be employed before it must be changed depends upon its rate of penetration ("ROP"), as well as its durability. The form and positioning of the cutting elements upon the cone cutters greatly impact bit durability and ROP, and thus are critical to the success of a particular bit design.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutting elements on the bit, and may accelerate wear of the cutter bearings, and ultimately lead to bit failure.

Conventional bits also typically include one or more rows of gage cutting elements. Gage cutting elements are mounted adjacent to the heel surface but orientated and sized in such a manner so as to cut the corner of the borehole. In this orientation, the gage cutting elements generally are required to cut both the borehole bottom and sidewall. The lower surface of the gage cutting elements engages the borehole bottom, while the radially outermost surface scrapes the sidewall of the borehole.

Conventional bits also include a number of additional rows of cutting elements that are located on the cones in rows disposed radially inward from the gage row. These cutting elements are sized and configured for cutting the bottom of the borehole and are typically described as inner row cutting elements and, as used herein, may be described as bottomhole cutting elements. Such cutters are intended to penetrate and remove formation material by gouging and fracturing formation material. In many applications, inner row cutting elements are relatively longer and sharper than those typically employed in the gage row or the heel row where the inserts ream the sidewall of the borehole via a scraping or shearing action.

Increasing ROP while simultaneously increasing the service life of the drill bit will decrease drilling time and allow valuable oil and gas to be recovered more economically. Accordingly, cutting element placement for the rotatable cutters of a drill bit which enable increased ROP and longer bit life would be particularly desirable.

BRIEF SUMMARY OF SOME OF THE PREFERRED EMBODIMENTS

These and other needs in the art are addressed in one embodiment by a rolling cone drill bit for drilling a borehole in earthen formations. In an embodiment, the drill bit comprises a bit body having a bit axis. In addition, the drill bit comprises a plurality of rolling cone cutters mounted on the bit body, each cone cutter having a cone axis of rotation. Each cone cutter includes a plurality of gage cutting elements arranged in a circumferential gage row, a first plurality of bottomhole cutting elements arranged in a first inner row axially adjacent the gage row relative to the cone axis, and a second plurality of bottomhole cutter elements arranged in a second inner row axially adjacent the first row relative to the cone axis. Each bottomhole cutting element of the first inner row is staggered relative to the gage cutting elements of the gage row on each cone cutter. Further, the profiles of the gage cutting elements in the gage row and the bottomhole cutting elements of the first inner row on each cone cutter overlap in rotated profile view. Each bottomhole cutting element of the second inner row is staggered relative to the bottomhole cutting elements of the first inner row on at least one cone cutter. Further, the profiles of the bottomhole cutting elements in the second inner row and the bottomhole cutting elements of the first inner row on at least one cone cutter overlap in rotated profile view.

These and other needs in the art are addressed in another embodiment by a rolling cone drill bit for drilling a borehole in earthen formations. In an embodiment, the drill bit comprises a bit body having a bit axis. In addition, the drill bit comprises a plurality of rolling cone cutters mounted on the bit body for rotation about a cone axis. Each cone cutter includes a plurality of gage cutting elements mounted in a gage zone, a first plurality of bottomhole cutting elements mounted in a drive zone, and a second plurality of bottomhole cutting elements mounted in an inner zone. The ratio of the total number of bottomhole cutter elements in the inner zone on all three cones to the total number of bottomhole cutter elements in the drive zone of all three cones is less than 0.84 when the drill bit has an IADC classification between 41$x$ and 44$x$; less than 0.70 when the drill bit has an IADC classification between 51$x$ and 54$x$; and less than 0.56 when the drill bit has an IADC classification between 61$x$ and 83$x$.

These and other needs in the art are addressed in another embodiment by rolling cone drill bit for drilling a borehole in earthen formations and defining a full gage diameter. In an embodiment, the drill bit comprises a bit body having a bit axis. In addition, the drill bit comprises a plurality of rolling cone cutters mounted on the bit body for rotation about a cone axis. Each cone cutter includes a plurality of gage cutting elements mounted in a circumferential gage row, a first plurality of bottomhole cutting elements mounted in a first circumferential inner row axially adjacent the gage row relative to the cone axis. Moreover, the bit has a normalized radial offset less than 0.64 when the drill bit has an IADC classification between 41$x$ and 44$x$; and less than 0.43 when the drill bit has an IADC classification between 51$x$ and 84$x$ .

These and other needs in the art are addressed in another embodiment by rolling cone drill bit for drilling a borehole in earthen formations and defining a full gage diameter. In an embodiment, the drill bit comprises a bit body having a bit axis. In addition, the drill bit comprises a plurality of rolling cone cutters mounted on the bit body, each cone cutter having a cone axis of rotation. Each cone cutter includes a plurality of gage cutting elements arranged in a circumferential gage row, a first plurality of bottomhole cutting elements arranged in a first inner row axially adjacent the gage row relative to the cone axis, and a second plurality of bottomhole cutter elements arranged in a second inner row axially adjacent the first inner row relative to the cone axis. A set of the plurality of bottomhole cutting elements of the first inner row are unstaggered relative to the gage cutting elements of the gage row on each cone cutter. Further, the profiles of the gage cutting elements in the gage row are axially spaced relative to the cone axis from the bottomhole cutting elements of the first inner row on each cone cutter in rotated profile view.

Thus, embodiments described herein comprise a combination of features and advantages intended to address various shortcomings associated with certain prior drill bits. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the preferred embodiment of the present invention, reference will now be made to the accompanying drawings, wherein:

FIG. 9 is a tabular summary of IADC bit classifications;

DETAILED DESCRIPTION OF THE PREFERRED EMBODIMENTS

Figure 1:
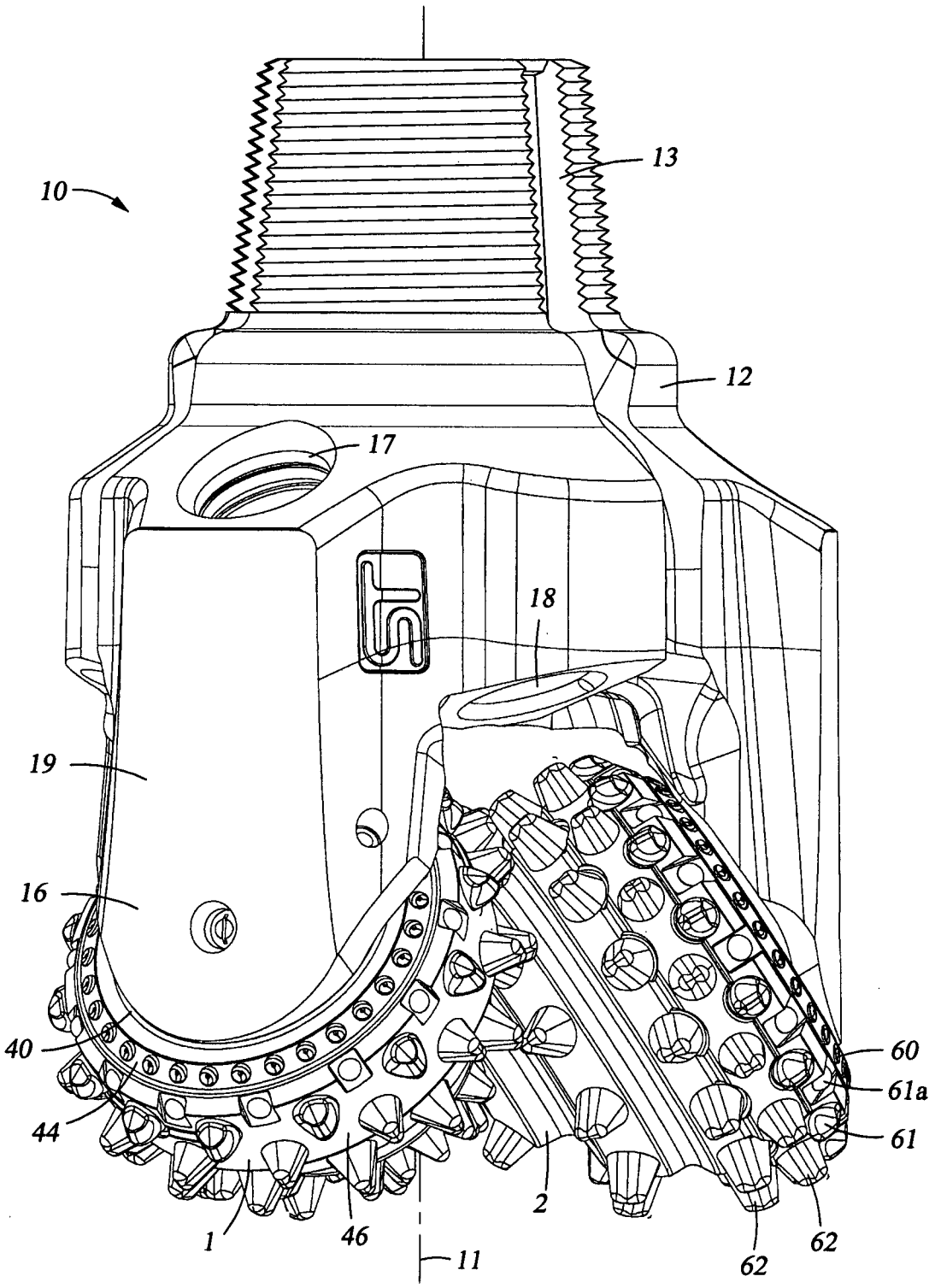
FIG. 1 is a perspective view of an embodiment of an earth-boring bit made in accordance with the principles described herein.

The following discussion is directed to various exemplary embodiments of the present invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices and connections.

Referring first to FIGS. 1, an earth-boring bit 10 is shown to include a central axis 11 and a bit body 12 having a threaded section 13 at its upper end that is adapted for securing the bit 10 to a drill string (not shown). Bit 10 has a predetermined gage diameter, defined by the outermost reaches of three rolling cone cutters 1, 2, 3 (cones 1 and 2 are visible in FIG. 1) which are rotatably mounted on bearing shafts that depend from the bit body 12. Bit body 12 is composed of three sections or legs 19 (two legs are visible in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters 1-3. Bit legs 19 include a shirttail portion 16 that serves to protect the cone bearings and cone seals from damage caused by cuttings and debris entering between leg 19 and its respective cone cutter. Although the embodiment illustrated in FIG. 1 shows bit 10 as including three cone cutters 1-3, in other embodiments, bit 10 may include any number of cone cutters, such as one, two, three, or more cone cutters.

Figure 2:
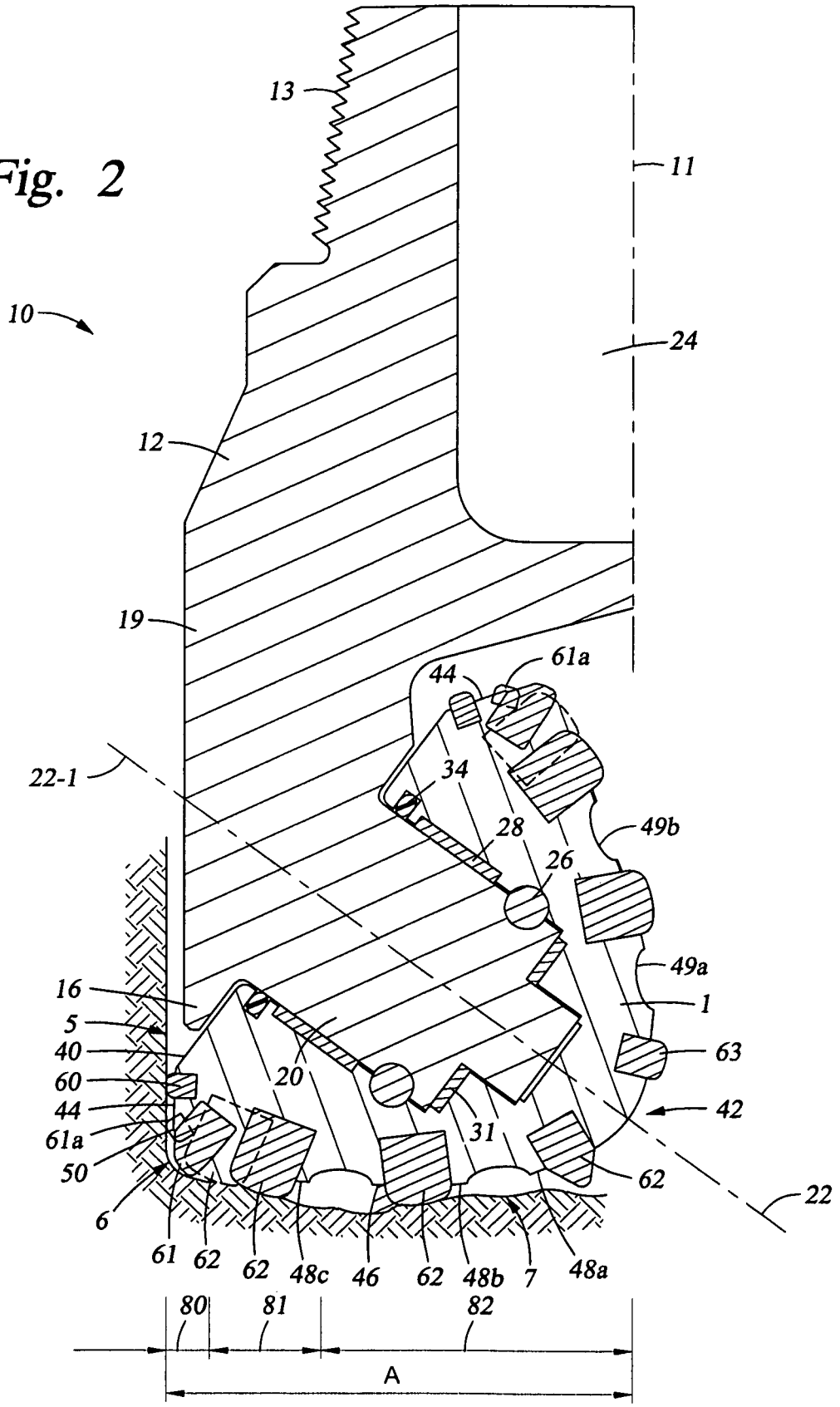
FIG. 2 is a partial section view taken through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial thrust and axial thrust are absorbed by journal sleeve 28 and thrust washer 31. The bearing structure shown is generally referred to as a journal bearing or friction bearing; however, the invention is not limited to use in bits having such structure, but may equally be applied in a roller bearing bit where cone cutters 1-3 would be mounted on pin 20 with roller bearings disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Referring still to FIGS. 1 and 2, each cutter 1-3 includes a generally planar backface 40 and nose 42 generally opposite backface 40. Adjacent to backface 40, cutters 1-3 further include a generally frustoconical surface 44 that is adapted to retain cutting elements that scrape or ream the sidewalls of the borehole as the cone cutters 1-3 rotate about the borehole bottom. Frustoconical surface 44 will be referred to herein as the "heel" surface of cone cutters 1-3, it being understood, however, that the same surface may be sometimes referred to by others in the art as the "gage" surface of a rolling cone cutter.

Extending between heel surface 44 and nose 42 is a generally conical cone surface 46 adapted for supporting cutting elements that gouge or crush the borehole bottom 7 as the cone cutters rotate about the borehole. Frustoconical heel surface 44 and conical surface 46 converge in a circumferential edge or shoulder 50. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions 48*a-c*, generally referred to as "lands", which are employed to support and secure the cutting elements as described in more detail below. Grooves 49*a, b* are formed in cone surface 46 between adjacent lands 48*a-c*.

In bit 10 illustrated in FIGS. 1 and 2, each cone cutter 1-3 includes a plurality of wear resistant inserts or cutting elements 60, 61*a*, 61, 62, 63. These cutting elements each include a generally cylindrical base portion with a central axis, and a cutting portion that extends from the base portion and includes a cutting surface for cutting formation material. The cutting surface may be symmetric or asymmetric relative to the central axis. All or a portion of the base portion is secured by interference fit into a mating socket formed in the surface of the cone cutter. Thus, as used herein, the term "cutting surface" is used to refer to the surface of the cutting element that extends beyond the surface of the cone cutter. The extension height of the insert or cutting element is the distance from the cone surface to the outermost point of the cutting surface of the cutting element as measured perpendicular to the cone surface.

Referring specifically to FIG. 2, cone 1 includes heel cutting elements 60 extending from heel surface 44. Heel cutting elements 60 are designed to ream the borehole sidewall 5. In this embodiment, heel cutting elements 60 are generally flat-topped elements, although alternative shapes and geometries may be employed. Moving axially with respect to cone axis 22-1 of cone 1, adjacent to shoulder 50, cone 1 includes nestled gage cutting elements 61*a* and gage cutting elements 61. Nestled gage cutting elements 61*a* and gage cutting elements 61 are designed to cut corner portion 6 of the borehole (i.e., a portion of sidewall 5 and a portion of borehole bottom 7). Thus, as used herein, the phrase "gage cutting element" refers to a cutting element that cut the corner portion (e.g., corner portion 6) of the borehole, and thus, engage the borehole sidewall (e.g., sidewall 5) and the borehole bottom (e.g., bottom 7). In this embodiment, gage cutting elements 61 include a cutting surface having a generally slanted crest, although alternative shapes and geometries may be employed. Although cutting elements 61 are referred to herein as gage or gage row cutting elements, others in the art may describe such cutting elements as heel cutters or heel row cutters. Axially between gage cutting elements 61 and nose 42, cone 1 includes a plurality of bottomhole cutting elements 62, also sometimes referred to as inner row cutting elements. Bottomhole cutting elements 62 are designed to cut the borehole bottom 7. Thus, as used herein, the phrases "bottomhole cutting element" and "inner row cutting element" refer to cutting elements that only cut the borehole bottom (e.g., bottom 7), but do not engage or cut any portion of the borehole sidewall (e.g., sidewall 5). Therefore, a cutting element that engages any portion of the borehole sidewall is not a bottomhole cutting element or an inner row cutting element. In this embodiment, bottomhole cutting elements 62 include cutting surfaces having a generally rounded chisel shape, although other shapes and geometries may be employed. Cone 1 further includes a plurality of ridge cutting elements 63 on nose 42 designed to cut portions of the borehole bottom 7 that are otherwise left uncut by the other bottomhole cutting elements 62. Although only cone cutter 1 is shown in FIG. 2, cones 2 and 3 are similarly, although not identically, configured.

Figure 3:
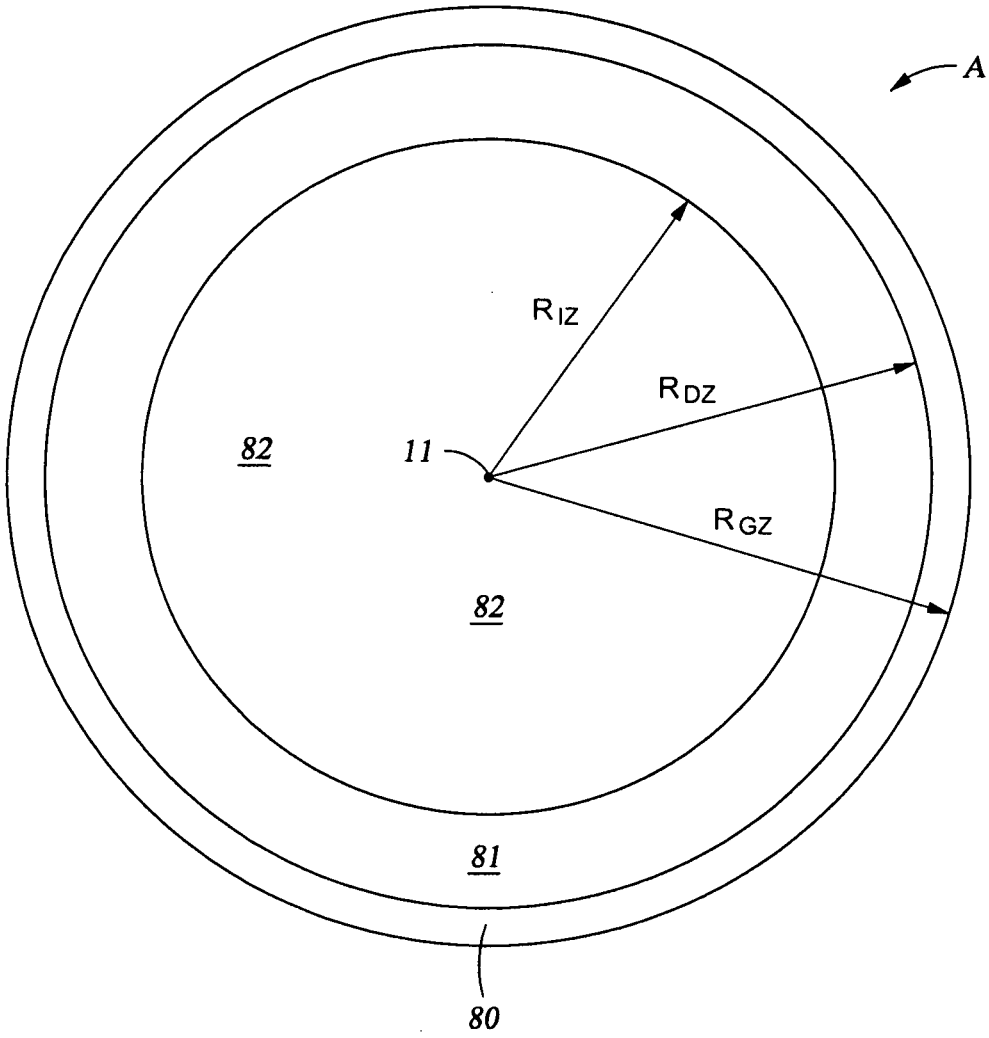
FIG. 3 is a schematic view of a borehole bottomhole divided into the gage, drive, and inner zones shown in FIG. 2.

Referring now to FIG. 3, the total bottomhole coverage area A of the borehole drilled by the bit 10 as viewed when looking downward along bit axis 11 is schematically shown. As previously described, heel cutting elements 60, gage cutting elements 61 and inner row cutting elements 62 are designed to cut sidewall 5, corner portion 6 and bottom 7, respectively, thereby creating the borehole. Thus, bottomhole coverage area A includes the area represented by bottom 7 and the lower or bottom portion of the area represented by corner portion 6 (FIG. 1).

Referring to FIGS. 2 and 3, each cone 1-3 of bit 10 and bottomhole coverage area A may be divided into a gage zone 80, a drive zone 81 and an inner zone 82. Gage zone 80 represents the radially outermost portion of the bottomhole cut by gage cutting elements 61, while drive zone 81 and inner zone 82 collectively, represent the radially inner portions of the bottomhole cut by inner row cutting elements 62. In particular, inner zone 82 extends radially from bit axis 11 to an inner zone radius $R_{iz}$, drive zone 81 extends from inner zone 82 to a drive zone radius $R_{dz}$, and gage zone 80 extends from drive zone 81 to the full gage radius $R_{fg}$. In general, the full gage radius (e.g., full gage radius $R_{fg}$) extends to the full bit diameter and defines the outermost radial reaches of the cutting elements of the drill bit. In this embodiment, inner zone 82 represents about 50% of total bottomhole coverage area A, drive zone 81 represents about 40% of total bottomhole coverage area A, and gage zone 80 represents about 10% of the total bottomhole coverage area A. Consequently, inner zone radius $R_{iz}$ is about 70% of full gage radius $R_{fg}$, drive zone radius $R_{dz}$ is about 95% of full gage radius $R_{fg}$. In other embodiments, the inner zone, the drive zone, and the gage zone may have slightly different dimensions and areas.

Figure 4:
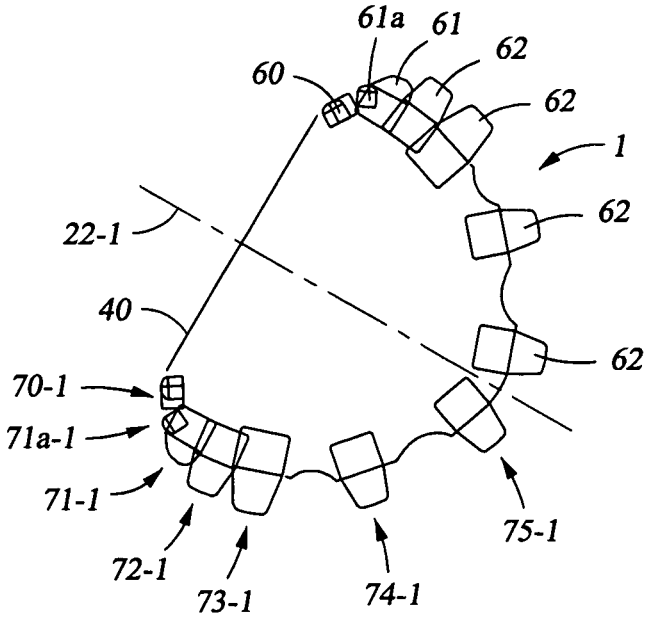
FIG. 4 is a schematic view showing, in rotated profile, the profiles of the cutting elements disposed in a first of the cone cutters shown in FIG. 1.

Referring now to FIG. 4, cone 1 is shown as it would appear with all cutting elements 60, 61*a*, 61, 62 rotated into a single rotated profile. Cone 1 comprises a cone axis 22-1, and a heel row 70-1 of heel cutting elements 60, which as described above, ream sidewall 5 of the borehole. Moving axially relative to cone axis 22-1 toward bit axis 11 (FIG. 1), cone 1 further includes a circumferential row 71*a*-1 of nestled gage cutting elements 61 a secured to cone 1 in locations along or near the circumferential shoulder 50 (FIG. 2), and a gage row 71-1 of gage cutting elements 61 on surface 46. Cutting elements 61*a*, 61 cut the corner portion 6 of the borehole. Cutting elements 61*a* are referred to as "nestled" because of their mounting position relative to the position of cutting elements 61, in that one or more cutting elements 61*a* is mounted in cone 1 between a pair of cutting elements 61 that are circumferentially adjacent to one another in gage row 71-1. Immediately adjacent gage row 71-1, cone 1 includes a first and second inner row 72-1, 73-1, respectively, of bottomhole cutting elements 62. Continuing to move axially inward relative to cone axis 22-1, cone 1 further includes a third and fourth inner row 74-1, 75-1, respectively, of bottomhole cutting elements 62. In general, cutting elements 62 of cone 1 are intended to cut the borehole bottom 7.

In this embodiment, the profiles of cutting elements 62 in first inner row 72-1 at least partially overlap with the profiles of gage cutting elements 61 in gage row 71-1, and further, the profiles of cutting elements 62 in second inner row 73-1 at least partially overlap with the profiles of cutting elements 62 in first inner row 72-1. Thus, as used herein, the term "overlap" and "overlapping" are used to refer to an arrangement of two or more cutting elements on a given cone whose profiles (extended portion or grip portion) at least partially overlap in rotated profile view. Cutting elements 62 in inner rows 74-1, 75-1 are sufficiently axially spaced apart from inner rows 72-1, 73-1 such that their profiles do not overlap.

It should be appreciated that the overlapping of cutting elements on adjacent rows requires that the overlapping cutting elements be staggered with respect to each other. As used herein, "staggered" is used to describe a cutting element on a given cone that is not directly azimuthally aligned with any cutting elements of a different row on the same cone, but rather, is azimuthally positioned between two adjacent cutting elements of the other row. Conversely, as used herein, "unstaggered" is used to refer to a cutting element in a row on a given cone that is directly azimuthally aligned with a cutter element of a different row on the same cone. In this embodiment, cutting elements 62 of first inner row 72-1 overlap and are staggered with respect to cutting elements 61 of gage row 71-1, and cutting elements 62 of second inner row 73-1 overlap and are staggered with respect to cutting elements 62 of first inner row 72-1. Thus, each cutting element 62 of first inner row 72-1 is azimuthally spaced between two cutting elements 61 in gage row 71-1, and each cutting element 62 in second inner row 73-1 is azimuthally spaced between two cutting elements 62 in first inner row 72-1. In other embodiments, two bottomhole cutting elements (e.g., cutting elements 62) in the first inner row (e.g., first inner row 72-1) may be azimuthally spaced between each adjacent pair of gage cutting elements (e.g., gage cutting elements 61) in the gage row (e.g., gage row 71-1).Although overlapping the profiles of cutting elements on adjacent rows in rotated profile view necessitates staggering, cutting elements that are staggered relative to each other need not be overlapping. Thus, cutting elements whose profiles do not overlap in rotated profile view may be staggered or unstaggered relative to each other (i.e., not azimuthally aligned or azimuthally aligned). Thus, cutting elements 62 in inner rows 74-1, 75-1 may be staggered or unstaggered relative to cutting elements 61 in gage row 71-1 and/or cutting elements 62 of inner rows 72-1, 73-1.

For a given size of cutting elements 61, 62, staggering cutting elements 61, 62 in adjacent rows 71-1, 72-1, 73-1, as well as overlapping of the profiles of cutting elements 61, 62 in adjacent rows 71-1, 72-1, 73-1, enables an increased number of total bottomhole cutting elements 62 to be positioned within the drive zone 81 of cone 1 as compared to similarly sized cones of conventional bits. In particular, staggering and overlapping cutting elements of adjacent rows (e.g., cutting elements 61, 62 of rows 71-1, 72-1, 73-1) enables the rows to be moved axially closer together relative to the cone axis (e.g., cone axis 22-1), thereby allowing for more total cutting elements within the drive zone (e.g., drive zone 81) of the cone. Without being limited by this or any particular theory, it is believed that increasing the total number and density of cutting elements in drive zone of a cone offers the potential for enhanced load sharing among the drive zone cutting elements, increased durability of the cutting elements in the drive zone, and improved ROP.

Although staggering and overlapping cutting elements of adjacent rows enables an increased total cutting element count, staggering may also impact the total count of cutting elements in each row. For instance, if cutting elements 62 of first inner row 72-1 are staggered relative to cutting elements 61 of gage row 71-1 such that one cutting element 62 in first inner row 72-1 is azimuthally disposed between each pair of circumferentially adjacent cutting elements 61 in gage row 71-1, then the total number of cutting elements 62 in first inner row 72-1 will be about the same as the total number of cutting elements 61 in gage row 71-1 (one cutting elements 61 in gage row 71-1 is provided for each cutting element 62 in first inner row 72-1). However, as another example, if cutting elements 62 of first inner row 72-1 are staggered relative to cutting elements 61 of gage row 71-1 such that one cutting element 62 in first inner row 72-1 is azimuthally disposed between every other pair of circumferentially adjacent cutting elements 61 in gage row 71-1, then the total number of cutting elements 62 in first inner row 72-1 will be about half (50%) of the total number of cutting elements 61 in gage row 71-1 (two cutting elements 61 in gage row 71-1 are provided for each cutting element 62 in first inner row 72-1). To achieve the desired increase in cutting element count in the drive zone (e.g., drive zone 81), the total number of cutting elements 62 in first inner row 72-1 is preferably at least 50%, and more preferably 100%, of the total number of cutting elements 61 provided in gage row 71-1. Likewise, the total number of cutting elements 62 in second inner row 73-1 is preferably at least 50%, and more preferably 100%, of the total number of cutting elements 62 in first inner row 72-1.

Figure 5:
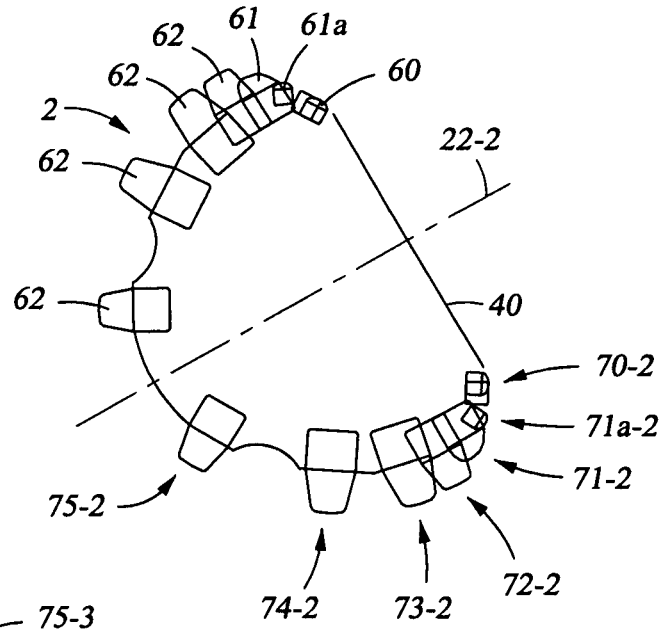
FIG. 5 is a schematic view showing, in rotated profile, the profiles of the cutting elements disposed in a second of the cone cutters shown in FIG. 1.

Referring now to FIG. 5, the profiles of cutting elements 60, 61*a*, 61, 62 of cone 2 are shown, in rotated profile view. Similar to cone 1 previously described, cone 2 comprises a central axis 22-2 and a heel row 70-2 of heel cutting elements 60 that ream sidewall 5 of the borehole. Moving axially with respect to the cone axis 22-2 toward bit axis 11 (FIG. 1), cone 2 further includes a row 71*a*-2 of nestled gage cutting elements 61*a* and a gage row 71-2 of gage cutting elements 61 for creating the corner portion 6 of the borehole. Cutting elements 61*a*, 61 cut the corner portion 6 of the borehole. Immediately adjacent gage row 71-2, cone 2 includes a first and second inner rows 72-2, 73-2, respectively, of bottomhole cutting elements 62. In this embodiment, the profiles of cutting elements 62 in first inner row 72-2 at least partially overlap with the profiles of gage cutting elements 61 in gage row 71-2, and the profile of cutting elements 62 of second inner row 73-2 at least partially overlap with the profiles of cutting elements 62 of first inner row 72-2. In addition, cutting elements 62 of first inner row are staggered with respect to cutting elements 61 of gage row 71-2, and cutting elements 62 of second inner row 73-2 are staggered with respect to cutting elements 62 of first inner row 72-2. Continuing to move axially inward relative to cone axis 22-2, cone 2 further includes a third and fourth inner row 74-2, 75-2, respectively, of bottomhole cutting elements 62.

For a given size of cutting elements 61, 62, staggering of cutting elements 61, 62 in adjacent rows 71-2, 72-2, 73-2, as well as overlapping of the profiles of cutting elements 61, 62 in adjacent rows 71-2, 72-2, 73-2, enables an increased number of bottomhole cutting elements 62 in drive zone 81 of cone 2 as compared to similarly sized cones of conventional bits. To achieve the desired increase in cutting element count in the drive zone (e.g., drive zone 81), the total number of cutting elements 62 in first inner row 72-2 is preferably at least 50%, and more preferably 100%, of the total number of cutting elements 61 provided in gage row 71-2. Likewise, the total number of cutting elements 62 in second inner row 73-2 is preferably at least 50%, and more preferably 100%, of the total number of cutting elements 62 in first inner row 72-2.

Figure 6:
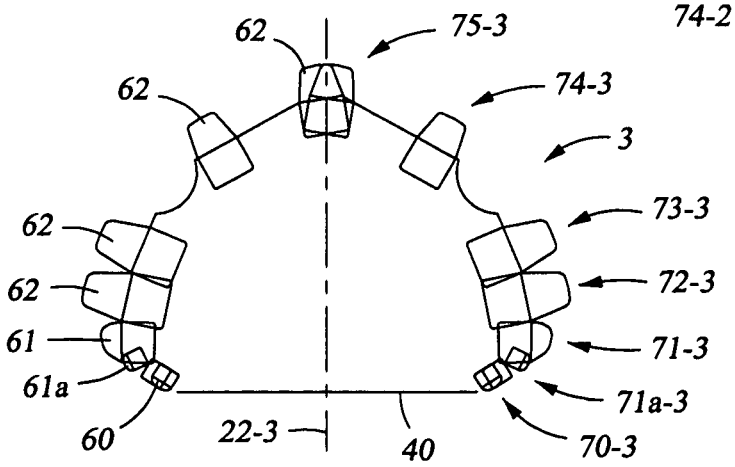
FIG. 6 is a schematic view showing, in rotated profile, the profiles of the cutting elements disposed in a third of the cone cutters shown in FIG. 1.

Referring now to FIG. 6, the profiles of cutting elements 60, 61*a*, 61, 62 of cone 3 are shown, in rotated profile view. Similar to cones 1 and 2 previously described, cone 3 includes a heel row 70-3 of heel cutting elements 60 that ream sidewall 5 of the borehole. Moving axially with respect to the cone axis 22-3 toward bit axis 11 (FIG. 1), cone 3 further includes a row 71*a*-3 of nestled gage cutting elements 61*a* and a gage row 71-3 of gage cutting elements 61 for creating the corner portion 6 of the borehole. Immediately adjacent gage row 71-3, cone 3 includes a first and second inner rows 72-3, 73-3, respectively, of bottomhole cutting elements 62. In this embodiment, the profiles of cutting elements 62 in first inner row 72-3 at least partially overlap with the profiles of gage cutting elements 61 in gage row 71-3, and the profile of cutting elements 62 of second inner row 73-3 at least partially overlap with the profiles of cutting elements 62 of first inner row 72-3. In addition, cutting elements 62 of first inner row are staggered with respect to cutting elements 61 of gage row 71-3, and cutting elements 62 of second inner row 73-3 are staggered with respect to cutting elements 62 of first inner row 72-3. Continuing to move axially inward relative to cone axis 22-3, cone 3 further includes a third and fourth inner row 74-3, 75-3, respectively, of bottomhole cutting elements 62.

For a given size of cutting elements 61, 62, staggering of cutting elements 61, 62 in adjacent rows 71-3, 72-3, 73-3, as well as overlapping of the profiles of cutting elements 61, 62 in adjacent rows 71-3, 72-3, 73-3, enables an increased number of bottomhole cutting elements 62 in drive zone 81 of cone 3 as compared to similarly sized cones of conventional bits. To achieve the desired increase in cutting element count in the drive zone (e.g., drive zone 81), the total number of cutting elements 62 in first inner row 72-3 is preferably at least 50%, and more preferably 100%, of the total number of cutting elements 61 provided in gage row 71-3. Likewise, the total number of cutting elements 62 in second inner row 73-3 is preferably at least 50%, and more preferably 100%, of the total number of cutting elements 62 in first inner row 72-3.

Figure 7:
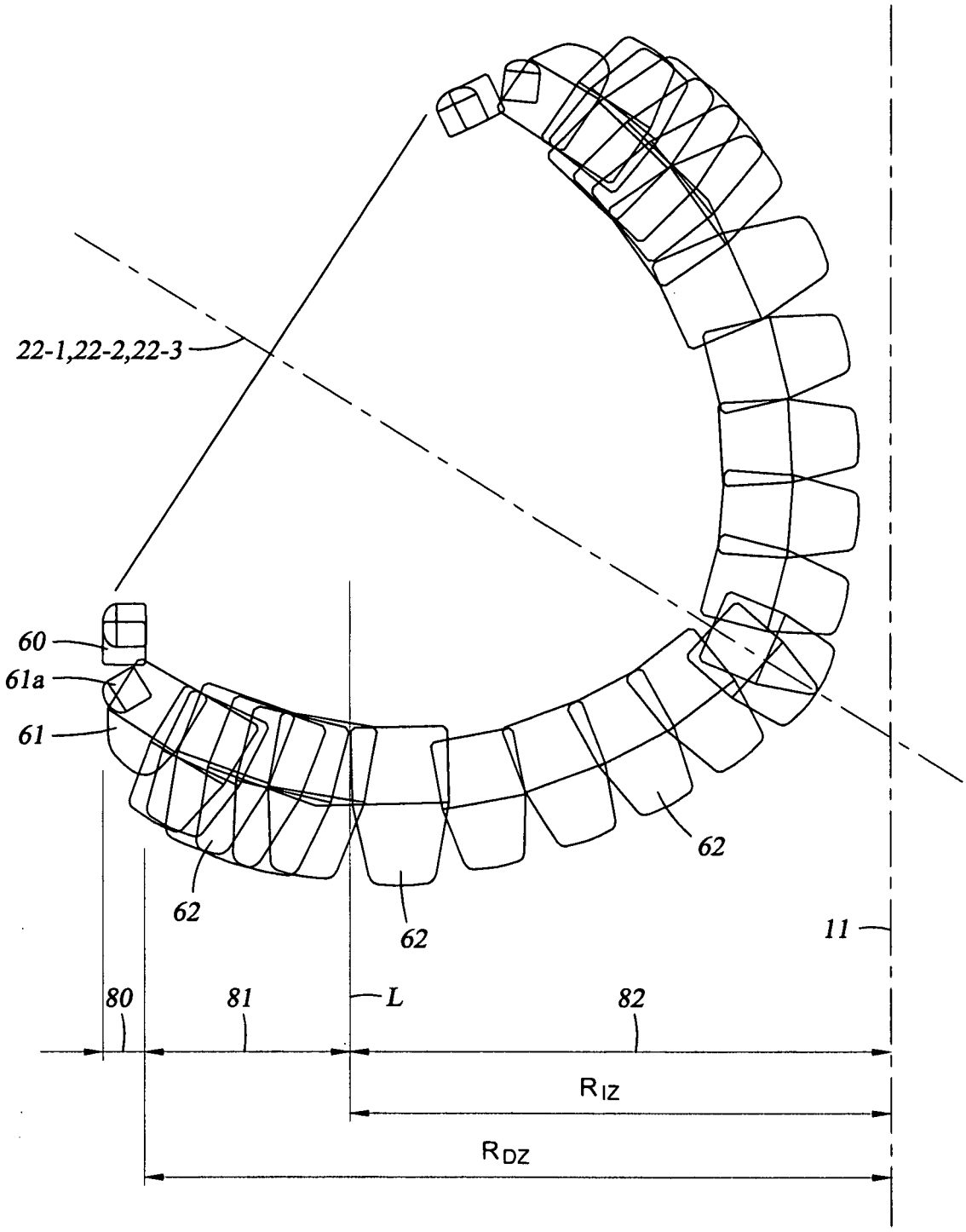
FIG. 7 is a schematic view showing, in composite rotated profile, the profiles of all of the cutting elements of the three cone cutters of the drill bit shown in FIG. 1.

Referring now to FIG. 7, the cutting surfaces, and hence profiles, of each of the cutting elements 60, 61*a*, 61, 62 of all three cones 1-3 are shown rotated into a single profile termed herein the "composite rotated profile view." In the composite rotated profile view, the overlap of the profiles of cutting elements 60, 61*a*, 61, 62 on cones 1-3 are shown. Staggering and overlapping rows 71-1, 72-1, 73-1 of cone 1, rows 71-2, 72-2, 73-2 of cone 2, and rows 71-3, 72-3, 73-3 of cone 3, as described above, allows for an increased total number of bottomhole cutting elements 62 in drive zone 81 of bit 10 as compared to most conventional bits of similar size. In general, increasing the insert or cutting element count in the drive zone offers the potential for increased ROP as compared to similarly sized conventional bits. In addition, increasing the insert count in the drive zone permits forces acting on the cutting elements in the drive zone to be distributed over a greater number of inserts, thereby offering the potential for increased service life.

In general, the total cutting element count in drive zone (e.g., drive zone 81) is the total number of bottomhole cutting elements (e.g., cutting elements 62) that sweep along the borehole bottom in the drive zone. In composite rotated profile view, bottomhole cutting elements that pass along the borehole between (a) the axially innermost (relative to the cone axis) gage row of gage cutting elements (e.g., gage rows 72-1, 71-2, 71-3 of gage cutting elements 61); and (b) a radial distance measured perpendicular to the bit axis (e.g., bit axis 11) representative of the radially inner 50% of the total bottomhole coverage area, or about 70% of the full gage radius (e.g., radius $R_{tz}$) are counted as being in the drive zone. As best shown in FIG. 7, moving axially upward from the borehole bottom along line L disposed at radius $R_{tz}$ from bit axis 11 and parallel to bit axis 11, any bottomhole cutting element 62 whose cutting tip is intersected by line L is counted as being in the drive zone 81. As used herein, the term "cutting tip" is used to refer to the outermost one-third of the cutting element extension measured perpendicular to the cone surface or steel.

Figure 8:
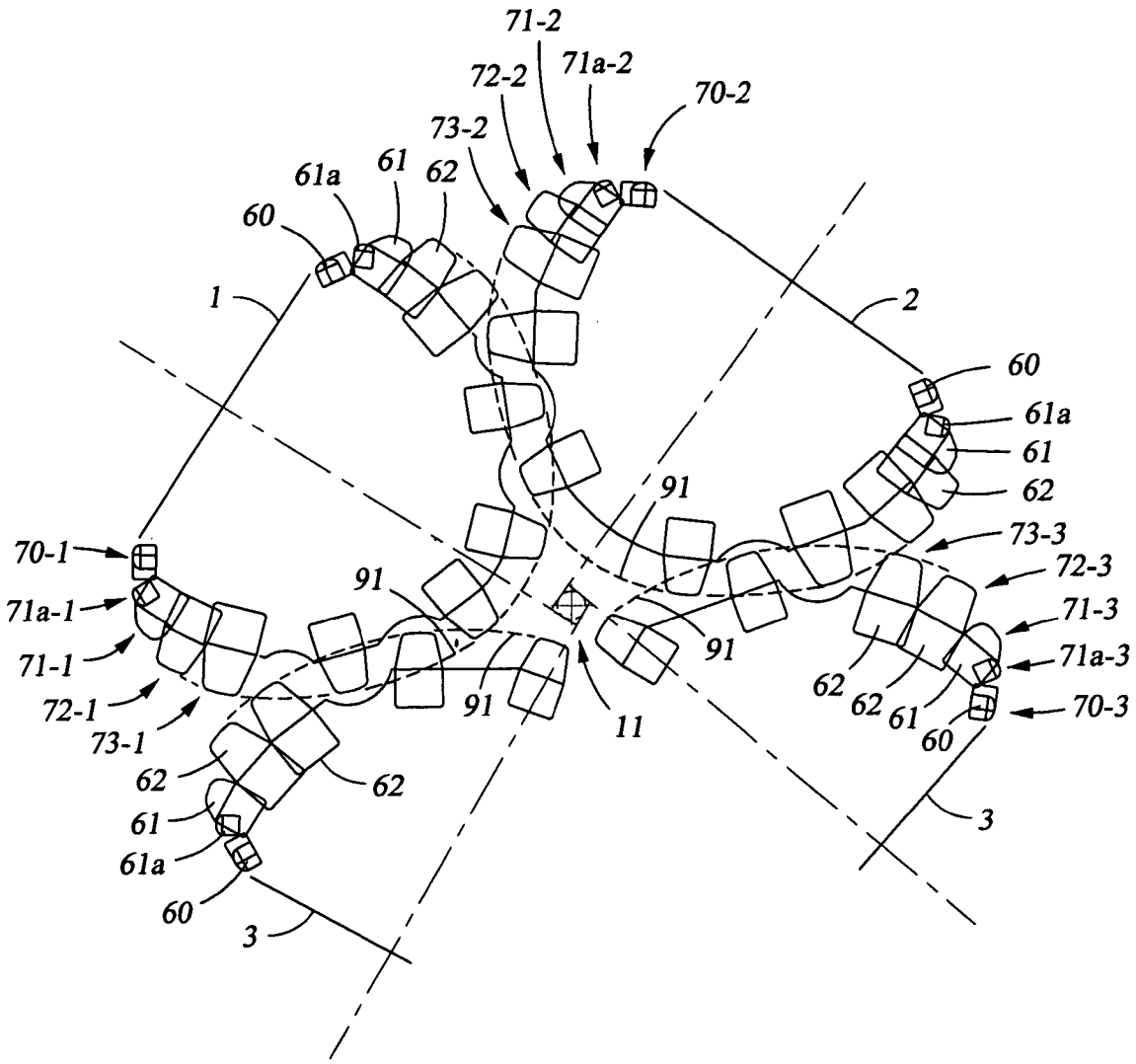
FIG. 8 is a cluster view showing, in rotated profile, the intermesh of the cutting elements of the drill bit shown in FIG. 1.

Referring now to FIG. 8, the intermeshed relationship between cones 1-3 previously described is shown. In this view, commonly termed a "cluster view," cone 3 is schematically represented in two halves so that the intermesh between cones 2 and 3 and between cones 1 and 3 may be depicted. Performance expectations of rolling cone bits typically require that the cone cutters be as large as possible within the borehole diameter so as to allow use of the maximum possible bearing size and to provide a retention depth adequate to secure the cutting element base within the cone steel.

To achieve maximum cone cutter diameter and still have acceptable insert retention and protrusion, some of the rows of cutting elements are arranged to pass between the rows of cutting elements on adjacent cones as the bit rotates. In some cases, certain rows of cutting elements extend so far that clearance areas or grooves corresponding to cutting paths taken by cutting elements in these rows are provided on adjacent cones so as to allow the bottomhole cutting elements on adjacent cutters to intermesh farther. The term "intermesh" as used herein is defined to mean overlap of any part of at least one cutting element on one cone cutter with the envelope defined by the maximum extension of the cutting elements on an adjacent cutter.

In FIG. 8, the intermeshed relationship between the cones 1-3 is schematically shown. Each cone cutter 1-3 has an envelope 91 defined by the maximum extension height of the cutting elements on that particular cone. The cutting elements that "intersect" or "break" the envelope 91 of an adjacent cone "intermesh" with that adjacent cone. For example, third inner row 74-1 of cone 1 breaks envelope 91 of cone 2 and breaks envelope 91 of cone 3 and therefore intermeshes with cone 2 and cone 3. Grooves may be positioned along cone surface 46 of cones 2, 3 to allow cutting elements 62 of third inner row 74-1 to pass between the cutting elements 62 of inner rows 73-3, 74-3 on cone 3 and between the cutting elements 62 of inner rows 74-2, 75-2 of cone 2 without contacting cone surface 46 of cone 1. It should be understood however, that in embodiments where the intermeshing cutting elements do not extend sufficiently far, clearance areas or grooves may not be necessary.

Intermeshing cones 1-3 allows the size of drill bit 10 to maximized, which in turn, permits an increased number of inserts. The combined effect offers the potential to enhance ROP. Moreover, intermeshing offers the potential to keep the bit 10 cleaner. As an insert on a cone passes between adjacent inserts on another cone, mud and/or formation material that may have collected between the adjacent inserts can be knocked free of the drill bit 10.

Embodiments of bits described herein (e.g., bit 10 shown in FIG. 1-8) are preferably designed for an IADC classification of 41*x* to 64*x*, and more preferably 41*x* to 44*x*. As those skilled in the art understand, the International Association of Drilling Contractors (IADC) has established a classification system for identifying bits that are suited for particular formations. According to this system, each bit falls within a particular 3-digit IADC bit classification outlined within the "BITS" section of the current edition of the International Association of Drilling Contractors (IADC) Drilling Manual. In general, the bit's IADC classification indicates the hardness and strength of the formation for which it is designed.

The first digit in the IADC classification designates the bit's "series" which indicates the type of cutting elements used on the roller cones of the bit as well as the hardness of the formation the bit is designed to drill. In general, a higher "series" numeral indicates that the bit is capable of drilling in a harder formation than a bit with a lower series number. As shown for example in FIG. 9, a "series" in the range 1-3 designates Milled Tooth Bits in the soft, medium and hard formations, respectively, while a "series" in the range 4-8 designates an insert bit or tungsten carbide insert (TCI) bit in the soft, medium, hard and extremely hard formations, respectively. Thus, the higher the series number used, the harder the formation the bit is designed to drill.

For instance, as shown in FIG. 9, a "series" designation of 4 designates TCI bits designed to drill soft formations with low compressive strength. Those skilled in the art will appreciate that bits designed for softer formations typically maximize the use of both conical and/or chisel inserts of large diameters and high projection combined with maximum cone offsets to achieve higher penetration rates and deep intermesh of cutting element rows to prevent bit balling in sticky formations. On the other hand, as shown in FIG. 9, a "series" designation of 8 designates TCI bits designed to drill extremely hard and abrasive formations. Those skilled in the art appreciate that such bits typically including more wear-resistant inserts in the outer rows of the bit to prevent loss of bit gauge and maximum numbers of hemispherical-shaped inserts in the bottomhole cutting rows to provide cutter durability and increased bit life.

The second digit in the IADC bit classification designates the formation "type" within a given series which represent a further breakdown of the formation type to be drilled by the designated bit. A higher "type" number indicates that the bit is capable of drilling in a harder formation than a bit of the same series with a lower type number. As shown in FIG. 9, for each of series 4 to 8, the formation "types" are designated as 1 through 4. In this case, type 1 represents the softest formation type for the series and type 4 represents the hardest formation type for the series. For example, a drill bit having the first two digits of the IADC classification as "63" would be used to drill harder formation than a drill bit with an IADC classification of "62".

The third digit in the IADC bit classification relates to the mounting arrangement of the roller cones and is generally not directly related to formation hardness or strength. Consequently, the third digit may be left off the bit designation or generically represented by an "x". For example, a "52*x*" IADC insert bit is capable of drilling in a harder formation than a "42*x*" IADC insert bit. A "53*x*" IADC insert bit is capable of drilling in harder formations than a "52*x*" IADC insert bit.

The IADC numeral classification system is subject to modification as approved by the International Association of Drilling Contractors to improve bit selection and usage. As used herein the phrase "IADC Series" is used to refer to all IADC classifications having the same first or series number. For instance, IADC Series 4 refers to IADC classifications 41*x* to 44*x*, collectively.

Figure 10:
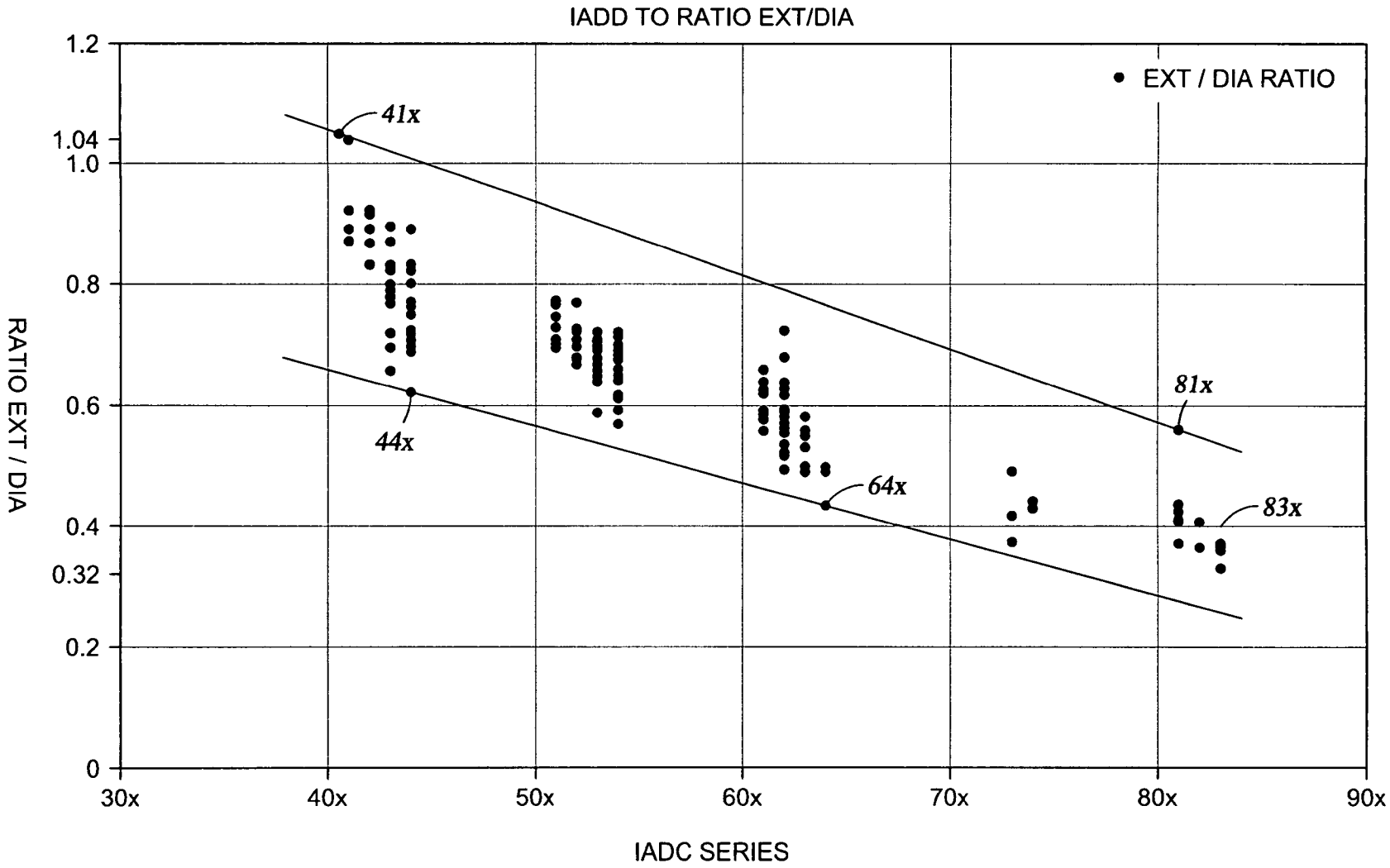
FIG. 10 is a graphical summary of the extension height-to-diameter ratios for rolling cone bits in IADC classes 41$x$ to 83$x$.

As shown in FIG. 10, IADC classifications 41*x* to 83*x* typically include inserts having extension height to diameter ratios between about 0.25 and 1.04, with IADC classifications of 41*x*-44*x* having extention height to diameter ratios between 0.60 and 1.00, IADC classifications of 51*x*-54*x* having extension height to diameter ratios between 0.50 and 0.80, IADC classifications of 61*x*-64*x* having extension height to diameter ratios between 0.45 and 0.80, and IADC classifications of 71*x* to 83*x* typically include inserts having extension height to diameter ratios between about 0.32 and 0.60. Consequently, bottomhole cutting elements 62 each preferably have an extension height to diameter ratio between 0.25 and 1.04, and more preferably have an extension height to diameter ratio between 0.32 and 1.00. More specifically, as summarized in Table 1 below, the bottomhole cutting elements (e.g., cutting elements 62) of the first inner row (e.g., first inner row 72-1, 72-2, 72-3) and the second inner row (e.g., second inner row 73-1, 73-2, 73-3) of IADC Series 4 (e.g., IADC classifications 41*x* to 44*x*) drill bit designed in accordance with the principles described herein preferably have an extension height to diameter ratio between 0.60 and 1.00, and more preferably between 0.80 and 1.00; and the bottomhole cutting elements of IADC Series 5 (e.g., IADC classifications 51*x* to 54*x*) drill bit designed in accordance with the principles described herein preferably have an extension height to diameter ratio between 0.50 and 0.80, and more preferably between 0.60 and 0.80.

TABLE 1

Preferred Extension Height to Diameter Ratio of Bottomhole Cutting Elements in the First Inner Row and the Second Inner Row

| IADC Class | Preferred Extension Height to Diameter Ratio | More Preferred Extension Height to Diameter Ratio |
|---|---|---|
| 41x to 44x | 0.60 to 1.00 | 0.80 to 1.00 |
| 41x to 51x | 0.50 to 0.80 | 0.60 to 0.80 |

Bits designed in accordance to the principles described herein (e.g., bit 10) preferably include cone cutters (e.g., cone cutters 1-3) with cone offsets generally larger than similar sized and similar IADC class conventional rolling cone bits. Cone offset is best described with reference to FIG. 11, which schematically shows cones 1-3 as they appear in the borehole.

Figure 11:
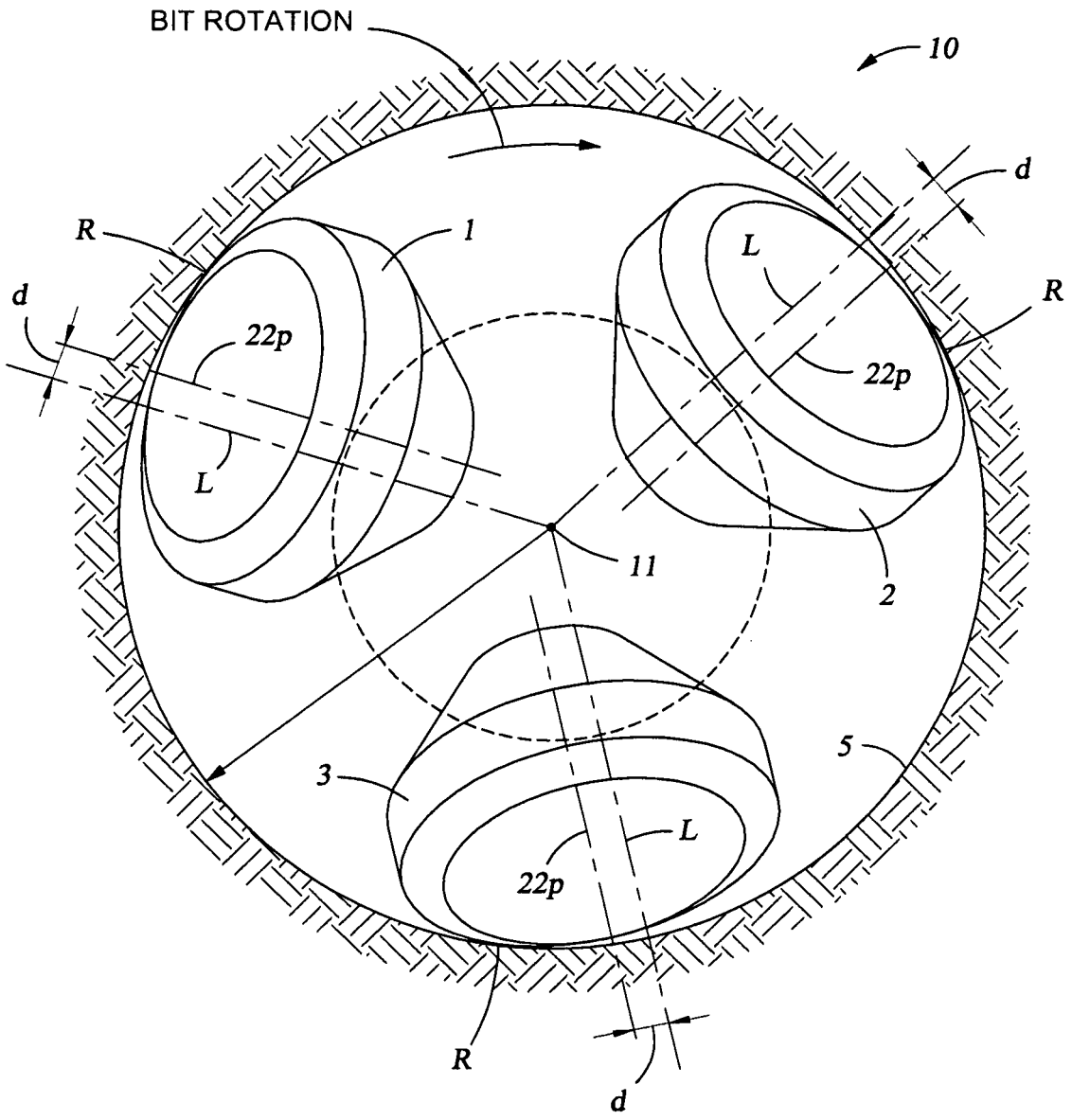
FIG. 11 is a schematic representation showing the three cone cutters of the bit shown in FIG. 1 as they are positioned in the borehole.

"Offset" is a term used to describe the orientation of a cone cutter (e.g., cone 1) and its axis (e.g., cone axis 22) relative to the bit axis (e.g., bit axis 11). More specifically, a cone is offset (and thus a bit may be described as having cone offset) when a projection of the cone axis does not intersect or pass through the bit axis, but instead passes a distance away from the bit axis. Referring to FIG. 11, cone offset may be defined as the distance "d" between the projection 22*p* of the rotational axis 22 of the cone cutter and a line "L" that is parallel to that projection 22*p* and intersects the bit axis 11. Thus, the larger the distance "d", the greater the offset.

Cone offset may be positive or negative. With negative offset, the region of contact of the cone cutter with the borehole sidewall (e.g., sidewall 5) is behind or trails the cone's axis of rotation (e.g., axis 22) with respect to the direction of rotation of the bit. On the other hand, with positive offset, the region of contact of the cone cutter with the borehole sidewall is ahead or leads the cone's axis of rotation with respect to the direction of rotation of the bit.

In a bit having cone offset (positive or negative), a rolling cone cutter is prevented from rolling along the hole bottom in what would otherwise be its "free rolling" path, and instead is forced to rotate about the centerline of the bit along a non-free rolling path. This causes the rolling cone cutter and its cutter elements to engage the borehole bottom in motions that may be described as skidding, scraping and sliding. These motions apply a shearing type cutting force to the borehole bottom. Without being limited by this or any other theory, it is believed that in certain formations, these motions can be a more efficient or faster means of removing formation material, and thus enhance ROP, as compared to bits having no cone offset (or relatively little cone offset) where the cone cutter predominantly cuts via compressive forces and a crushing action. In general, the greater the offset distance, whether positive or negative, the greater the formation removal and ROP. However, it should also be appreciated that such shearing cutting forces arising from cone offset accelerate the wear of cutter elements, especially in hard, more abrasive formations, and may cause cutter elements to fail or break at a faster rate than would be the case with cone cutters having no offset. This wear and possibly breakage is particularly noticeable in the gage row where the cutter elements cut the corner of the borehole to maintain the borehole at full gage diameter. Consequently, the magnitude of cone offset is typically limited in conventional roller cone bits. However, embodiments described herein include an increased number of bottomhole cutting elements (e.g., bottomhole cutter elements 62) in the drive zone (e.g., drive zone 81), and further, include cutting elements in the first inner row (e.g., first inner row 72-1) that at least partially overlap with the profiles of the gage cutting elements (e.g., gage cutting elements 61) in the gage row (e.g., gage row 71-1). Without being limited by this or any particular theory, the increased number of cutting elements in the drive zone and the overlapping of the cutting elements in the first inner row and the gage row enables increased load sharing between the gage cutting elements and the first inner row cutting elements, and enhanced protection of the gage cutting elements. As a result, embodiments described herein offer the potential to accommodate larger magnitude cone offsets as compared to conventional roller cone bits of similar size and IADC class before wear and breakage of gage cutting elements is of particular concern.

Referring still to FIG. 11, in this embodiment, each cone has a positive offset, and thus, the region of contact R of each cone cutter 1-3 with the borehole sidewall 5 is ahead of its respective cone axis 22 relative to the direction of rotation of bit 10. Further, in this embodiment, each cone cutter 1-3 has substantially the same offset distance d. In other embodiments, all three cone cutters may have negative offset, select cones may have negative offsets and other positive offset, one or more cones may have a different magnitude offset than a different cone, or combinations thereof.

Varying the magnitude of the offsets among the cone cutters provides a bit designer the potential to improve ROP and other performance criteria of the bit. In the embodiments described herein, the cone cutters preferably have uniform positive cone offset. Further, the cone cutters preferably have a larger magnitude cone offset distance as compared to conventional roller cone bits of similar size and IADC class. Table 2 below illustrates the preferred offset distance for each cone cutter for IADC class 41*x* to 51*x* bits designed in accordance with the principles described herein with bit diameters less than 9.875 in. and greater than or equal to 9.875 in. These preferred offset distances are generally larger than the offset distances of each cone in a conventional three cone bits in IADC classes 41*x* to 51*x* and of similar diameter. As compared to a conventional three cone bit, providing the bit with a larger offset for cones 1-3 would be expected to provide a higher bit ROP if other factors remained the same.

TABLE 2

Preferred Cone Offset Distance for IADC Class 41x to 51x Bits

| IADC Class | Bit Diameter | Preferred Positive Offset Distance of Each Cone |
|---|---|---|
| 41x to 51x | less than 9.875 in. | greater than +0.219 in. |
| 41x to 51x | greater than or equal to 9.875 in. | greater than +0.375 in. |

As previously described, the total insert or cutting element count in drive zone 81 of bit 10 is increased as compared to similarly sized conventional bits by staggering and overlapping the cutting elements 61, 62 of rows 71-1, 72-1, 73-1 of cone 1, rows 71-2, 72-2, 73-2 of cone 2, and rows 71-3, 72-3, 73-3 of cone 3. The "insert density" in the drive zone provides one means of quantifying the increase in the insert or cutting element count in the drive zone (e.g., drive zone 81). As used herein, the phrase "insert density" is used to refer to the number of cutting elements per unit area of cone surface (e.g., square inch, square centimeter, etc.) within a particular region on a cone, such as in the drive zone.

Figure 12:
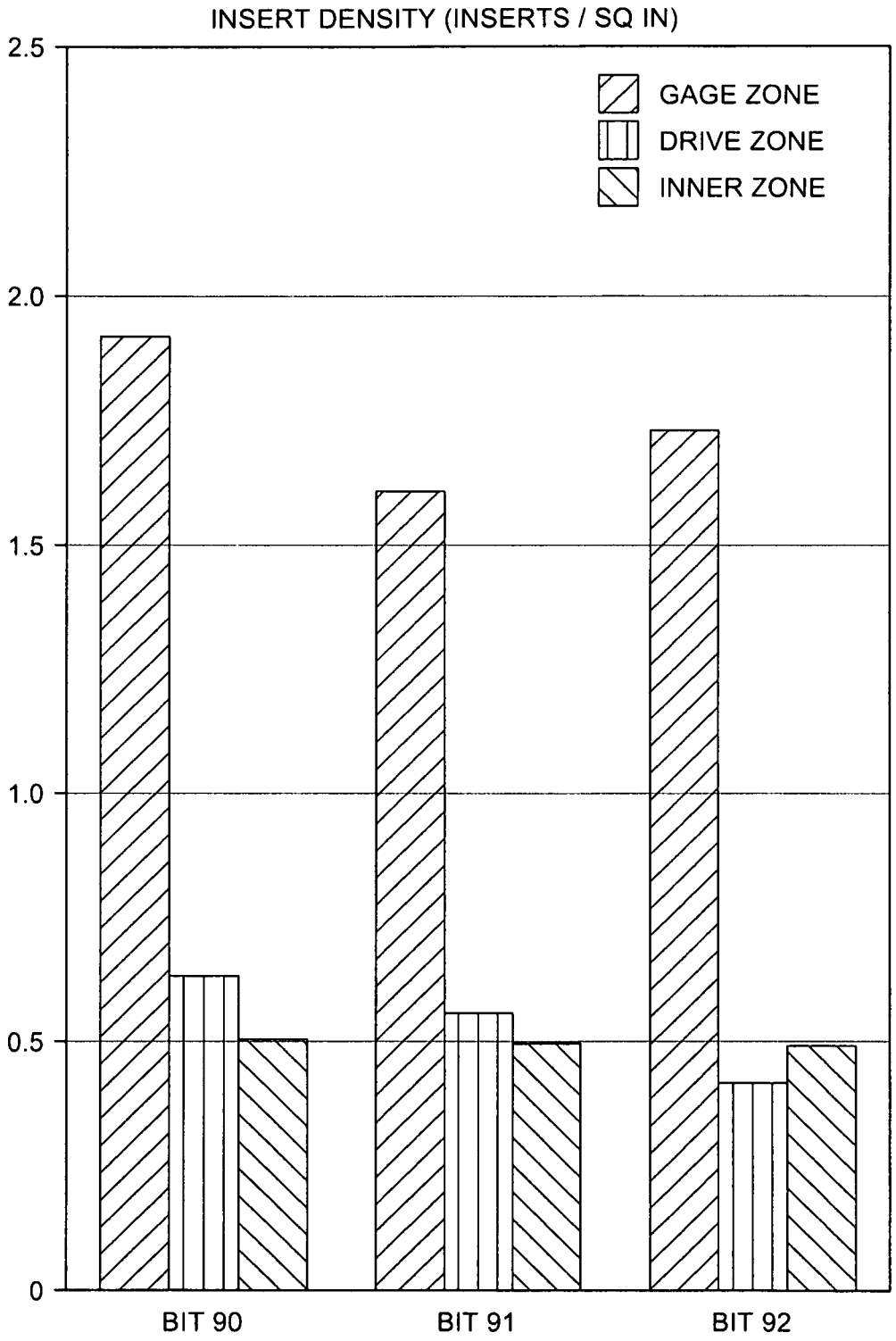
FIG. 12 is a graphical comparison of a bit designed in accordance with the principles described herein and two similarly sized conventional bits.

Referring now to FIG. 12, the insert density, expressed in terms of cutting elements or inserts per square inch of cone surface area within the gage zone, drive zone and inner zone of three IADC class 42*x* bits, each having a similarly sized 16" diameter are compared—an exemplary bit 90 designed in accordance with the principles described herein, a more recent conventional bit 91, and a more traditional bit 92.

Bit 90 has a gage zone insert density greater than 1.85 inserts/in.$^2$, and more specifically about 1.911 inserts/in.$^2$. In addition, bit 90 has a drive zone insert density greater than 0.60 inserts/in.$^2$, and more specifically about 0.626 inserts/in.$^2$. More recent conventional bit 91 has a gage zone insert density of about 1.602 inserts/in.$^2$, and a drive zone insert density of about 0.551 inserts/in.$^2$. Traditional bit 92 has a gage zone insert density of about 1.70 inserts/in.$^2$, and a drive zone insert density of about 0.413 inserts/in.$^2$. Thus, as compared to similarly sized and similar IADC class 42*x* conventional bits 91, 92, exemplary bit 90 constructed in accordance with the principles described herein has an increased insert density in the drive zone.

Figure 13:
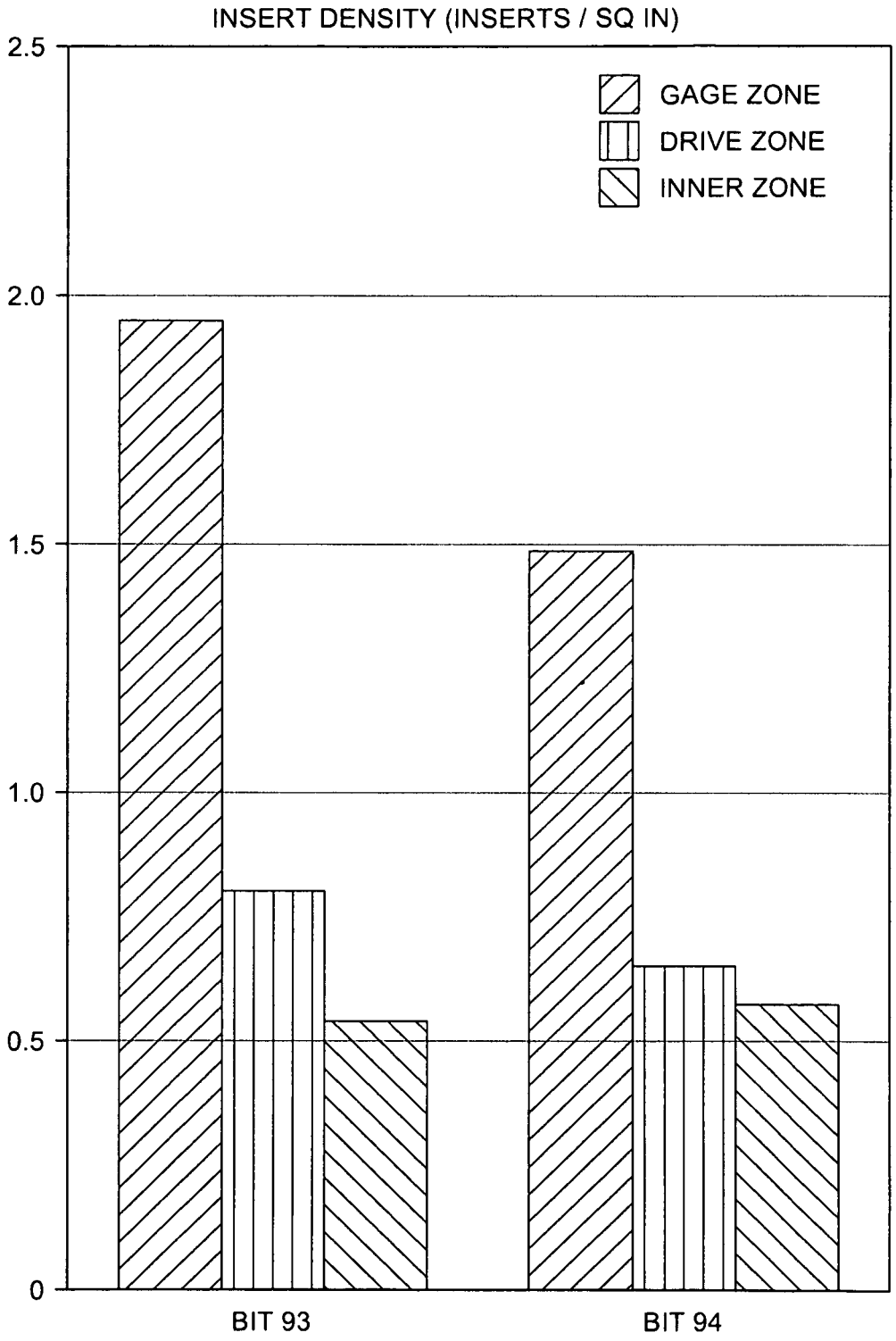
FIG. 13 is a graphical comparison of a bit designed in accordance with the principles described herein and a similarly sized conventional bit.

Referring now to FIG. 13, the insert density, expressed in terms of cutting elements or inserts per square inch of cone surface area within the gage zone, drive zone and inner zone of two IADC class 44*x* bits, each being a similarly sized 17½" bit are compared—an exemplary bit 93 designed in accordance with the principles described herein, and a conventional bit 94. Bit 93 has a gage zone insert density greater than 1.90 inserts/in.$^2$, and more specifically about 1.947 inserts/in.$^2$. In addition, bit 93 has a drive zone insert density of greater than 0.75 inserts/in.$^2$, and more specifically about 0.803 inserts/in.$^2$. Conventional bit 94 has a gage zone insert density of about 1.498 inserts/in.$^2$, and a drive zone insert density of about 1.653 inserts/in.$^2$. Thus, as compared to similarly sized and similar IADC class 44*x* conventional bit 94, exemplary bit 93 constructed in accordance with the principles described herein has an increased insert density in the drive zone.

Figure 14:
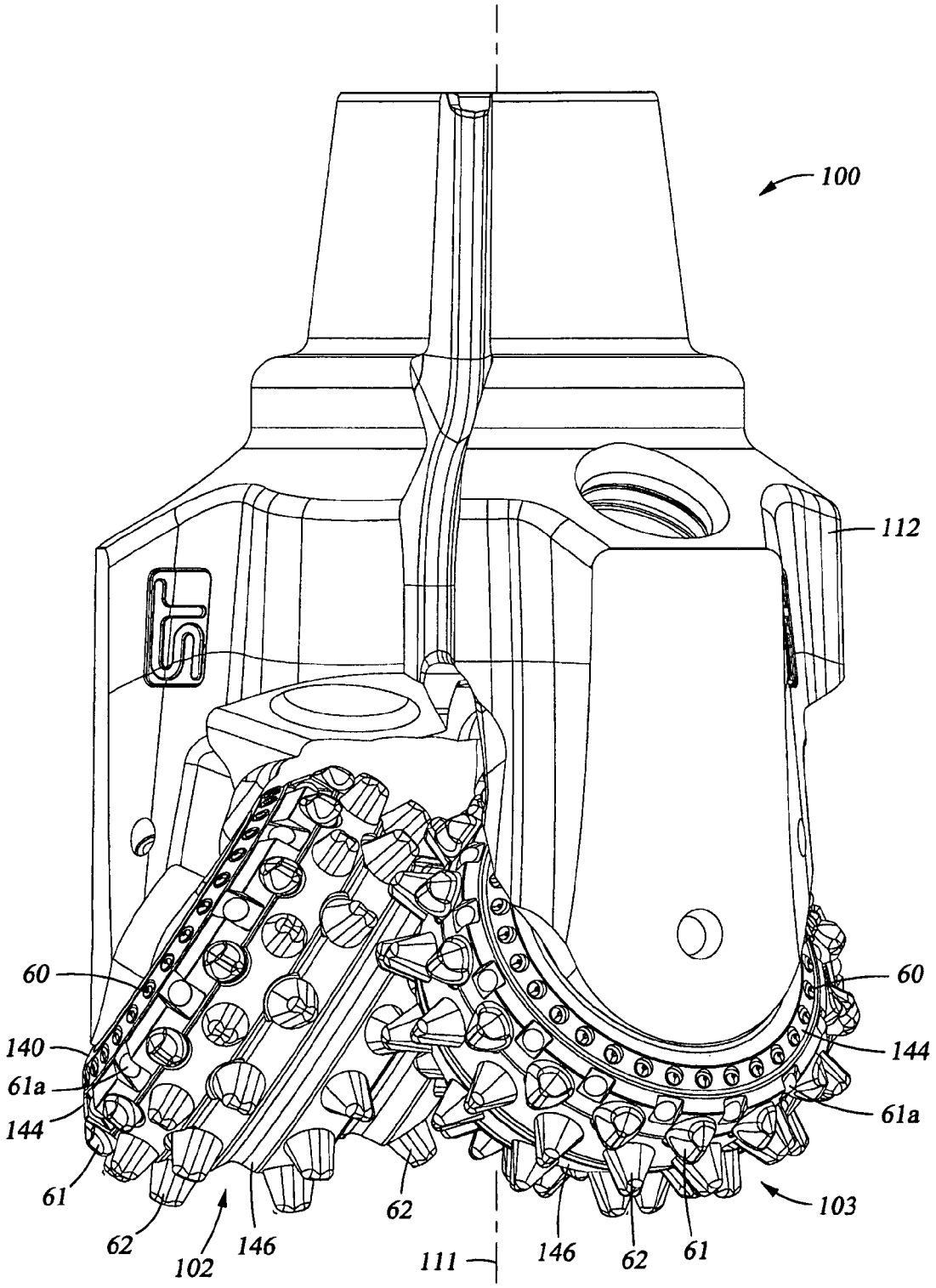
FIG. 14 is a perspective view of an embodiment of an earth-boring bit made in accordance with the principles described herein.
Figure 15:
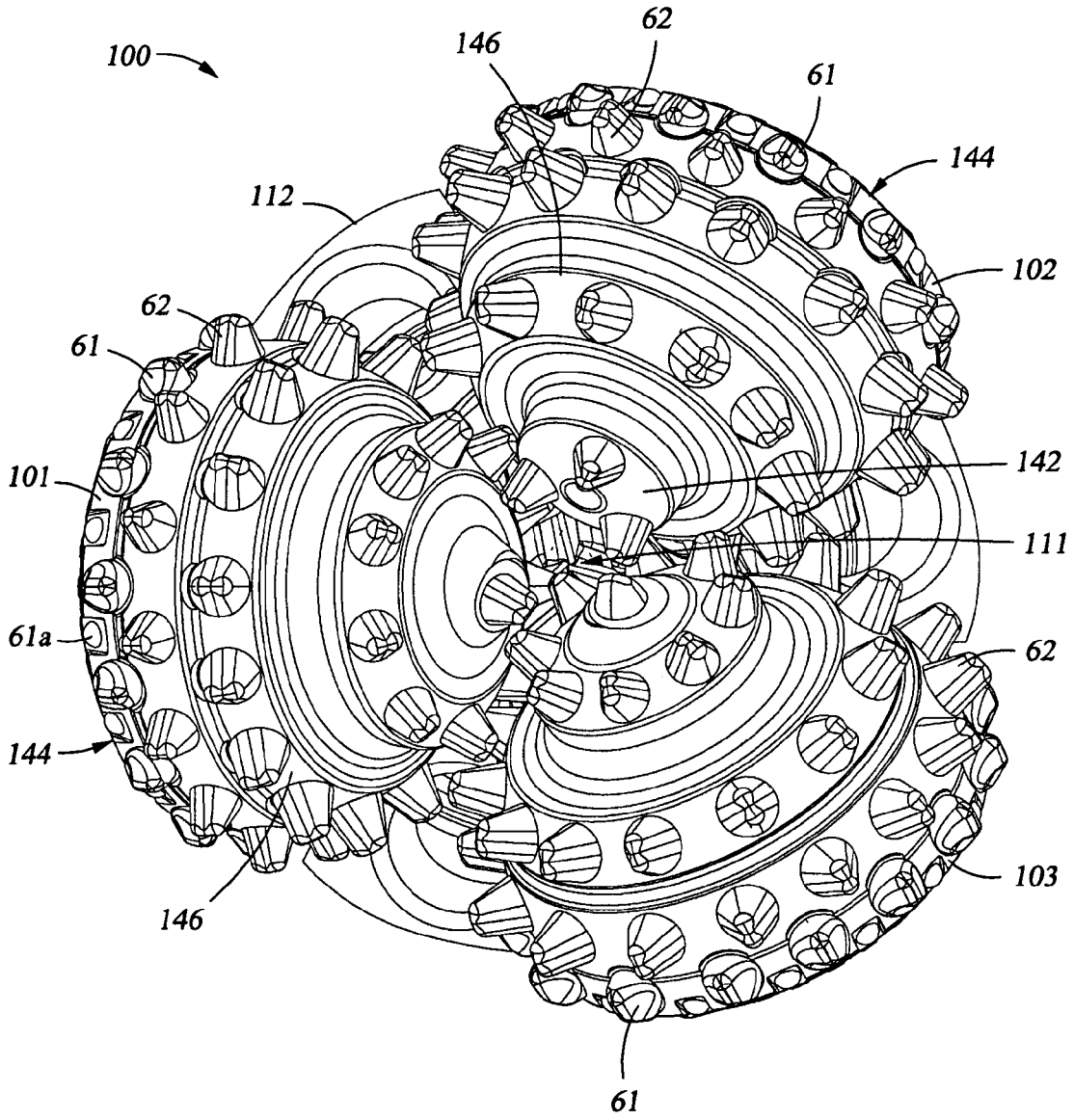
FIG. 15 is a bottom view of the bit of FIG. 14.

Referring now to FIGS. 14 and 15, another embodiment of an earth-boring bit 100 is shown. Bit 100 is similar to bit 10 previously described. Bit 100 includes a central axis 111 and a bit body 112. Bit 100 has a predetermined gage diameter, defined by the outermost reaches of three rolling cone cutters 101-103 which are rotatably mounted on bearing shafts that depend from the bit body 112.

Each cone cutter 101-103 includes a generally planar backface 140 and nose 142 generally opposite backface 140. Adjacent to backface 140, cone cutters 101-103 further include a generally frustoconical heel surface 144. Extending between heel surface 144 and nose 142 is a generally conical cone surface 146 adapted for supporting cutting elements that gouge or crush the borehole bottom as the cone cutters rotate about the borehole. In bit 100 illustrated in FIGS. 14 and 15, each cone cutter 101-103 includes a plurality of wear resistant inserts or cutting elements 60, 61*a*, 61, 62 as previously described.

Figure 16:
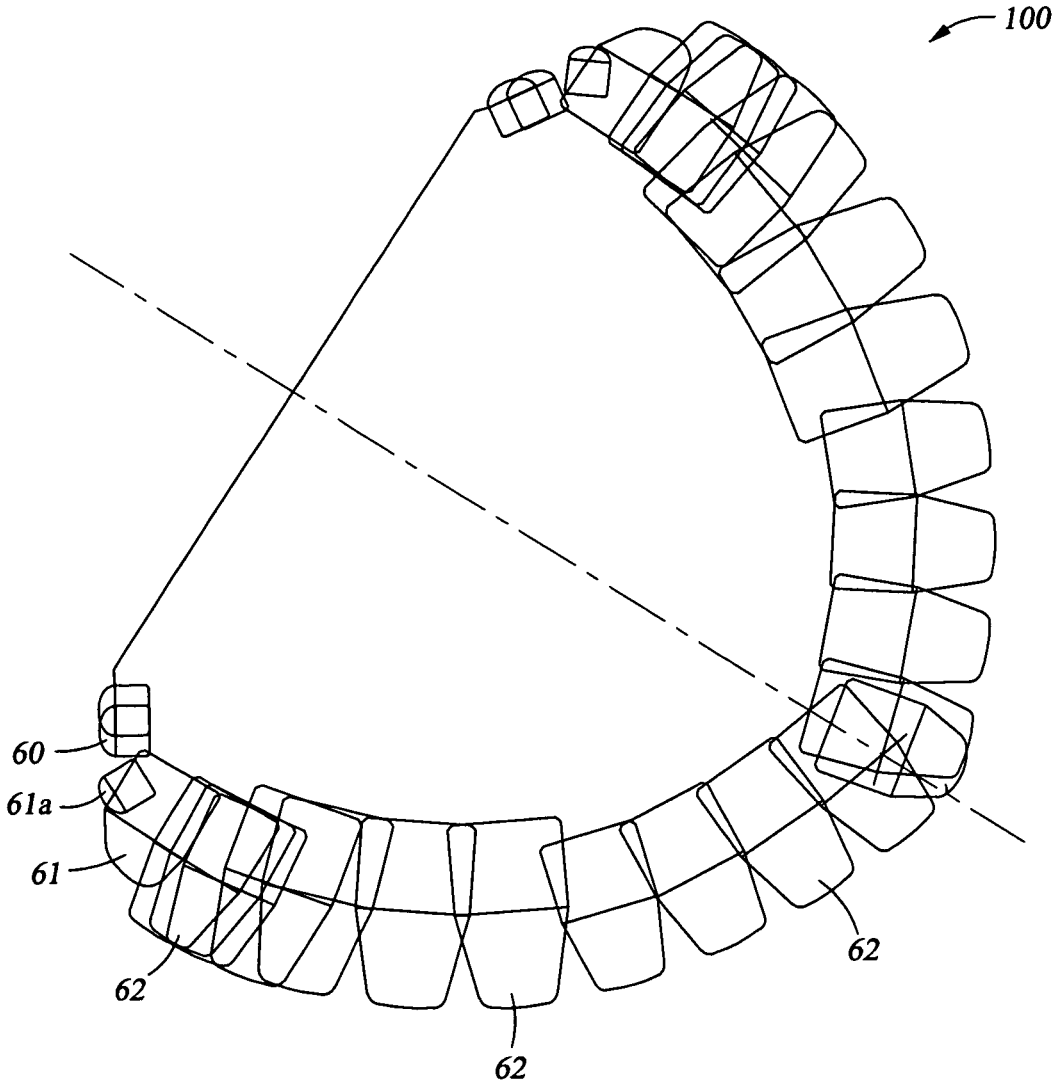
FIG. 16 is a schematic view showing, in composite rotated profile, the profiles of all of the cutting elements of the three cone cutters of the drill bit shown in FIG. 14.
Figure 17:
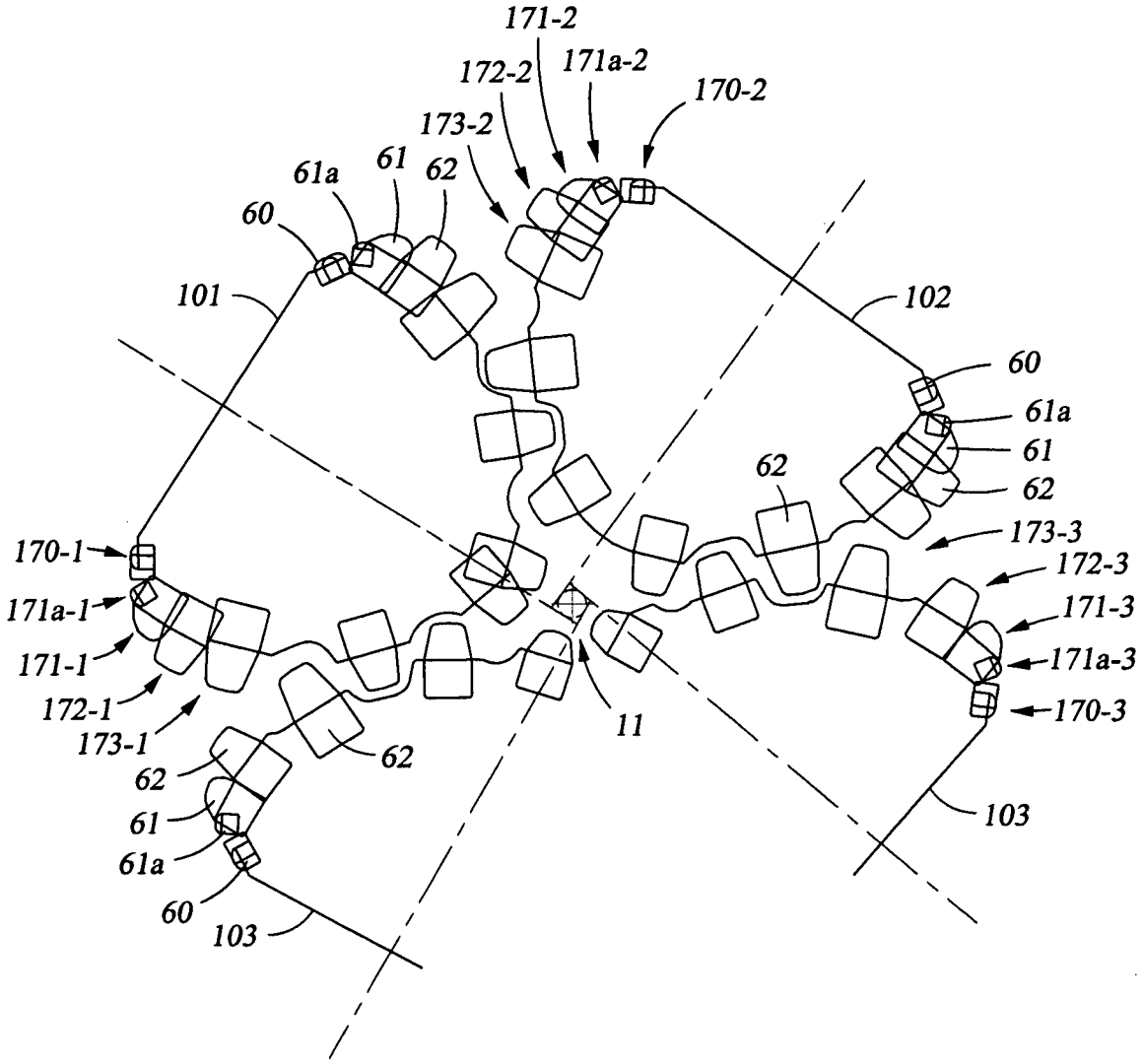
FIG. 17 is a cluster view showing, in rotated profile, the intermesh of the cutting elements of the drill bit shown in FIG. 14.

Referring now to FIGS. 16 and 17, the composite rotated profile view and the cluster views, respectively, of cutting elements 60, 61*a*, 61, 62 of cones 101-103 are illustrated. In this embodiment, each cone 101, 102, 103 comprises a heel row 170-1, 170-2, 170-3, respectively, of heel cutting elements 60, a nestled gage row 171*a*-1, 171*a*-2, 171*a*-3, respectively, of nestled gage cutting elements 61*a*, and a gage row 171-1, 171-2, 171-3, respectively, of gage cutting elements 61. Immediately adjacent gage rows 171-1, 171-2, 171-3, each cone 101, 102, 103 further includes a first inner row 172-1, 172-2, 172-3, respectively, of bottomhole cutting elements 62, and a second inner row 173-1, 173-2, 173-3, respectively, of bottomhole cutting elements 62, respectively.

In this embodiment, cutting elements 62 in first inner row 172-1, 172-2, 172-3 are staggered relative to cutting elements 61 of gage row 171-1, 171-2, 171-3, respectively. In addition, the profiles of cutting elements 62 in first inner row 172-1, 172-2, 172-3 at least partially overlap with the profiles of cutting elements 61 of gage row 171-1, 171-2, 171-3, respectively. Further, cutting elements 62 in second inner row 173-1, 173-2 are staggered relative to cutting elements 62 in first inner row 172-1, 172-2, respectively. In addition, the profiles of cutting elements cutting elements 62 in second inner row 173-1, 173-2 overlap with the profiles of cutting elements 62 in first inner row 172-1, 172-2, respectively. However, in this embodiment, cutting elements 62 of second inner row 173-3 are unstaggered relative to cutting elements 62 in first inner row 172-3, and further, the profiles of cutting elements 62 of second inner row 173-3 do not overlap with the profiles of cutting elements 62 in first inner row 172-3. It should be appreciated that unstaggered cutting elements of different rows (e.g., cutting elements 62 of first inner row 172-3 and second inner row 173-3) can have completely different and independent number of cutting elements. Thus, second inner row 173-3 can have a cutting element count that is independent from the cutting element count in first inner row 172-3.

The staggering and overlapping of gage row 171-1, 171-2, 171-3 with first inner row 172-1, 172-2, 172-3, respectively, offers the potential for an increased number of cutting elements 62, and associated insert density, in the drive zone as compared to most conventional bits of similar size. In addition, the staggering and overlapping of first inner row 172-1, 172-2 with second inner row 173-1, 173-2, respectively, further enables an increase in the number of cutting elements 62, and associated insert density, in the drive zone as compared to most conventional bits of similar size. Embodiments of bit 100 are preferably designed for an IADC classification of 41*x* to 83*x*, and more preferably 43*x* to 74*x*. Thus, bottomhole cutting elements 62 of bit 100 each preferably have an extension height to diameter ratio between 0.25 and 1.04, and more preferably have an extension height to diameter ratio between 0.40 and 0.90.

Figure 18:
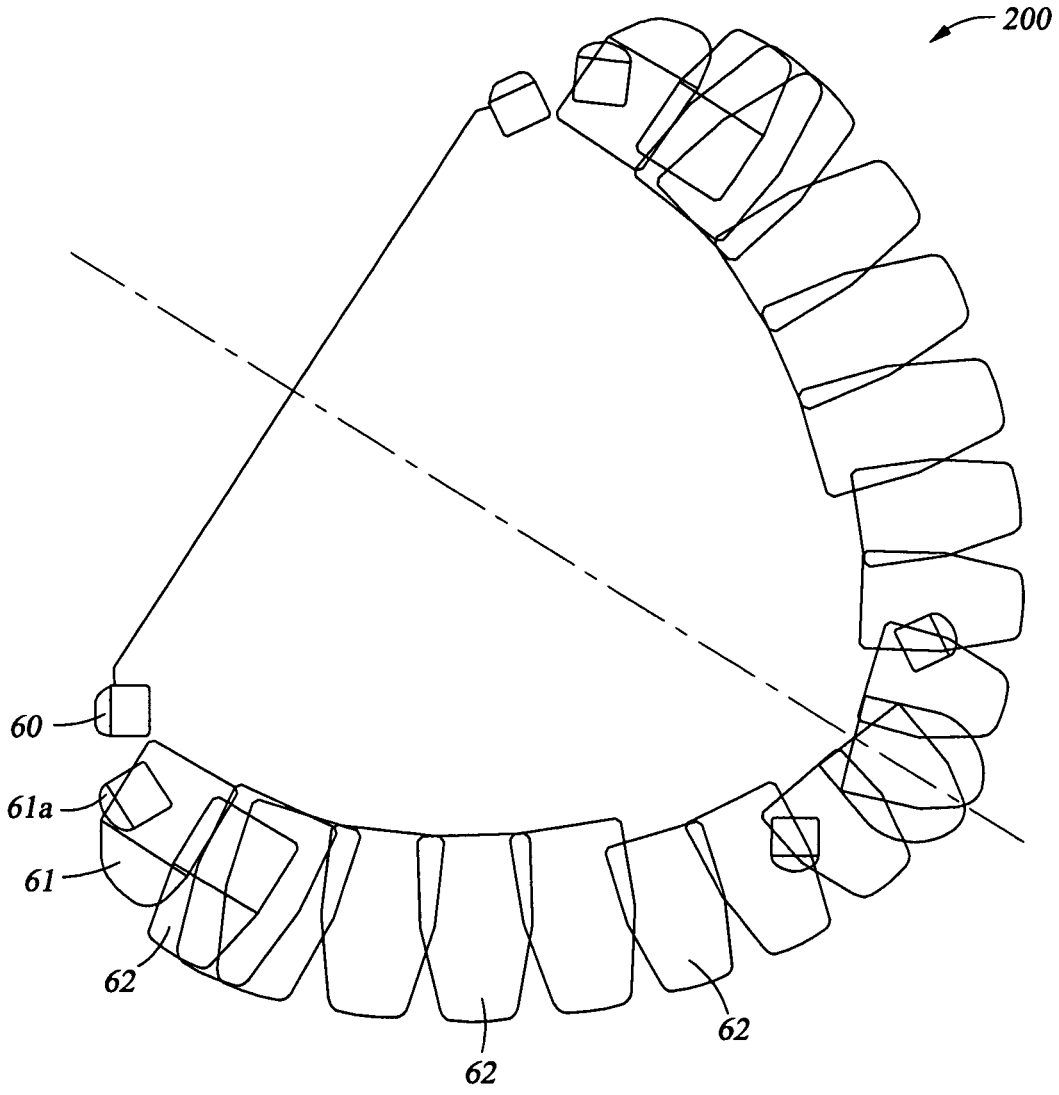
FIG. 18 is a schematic view showing, in composite rotated profile, the profiles of all of the cutting elements of the three cone cutters of an embodiment of an earth-boring bit made in accordance with the principles described herein.
Figure 19:
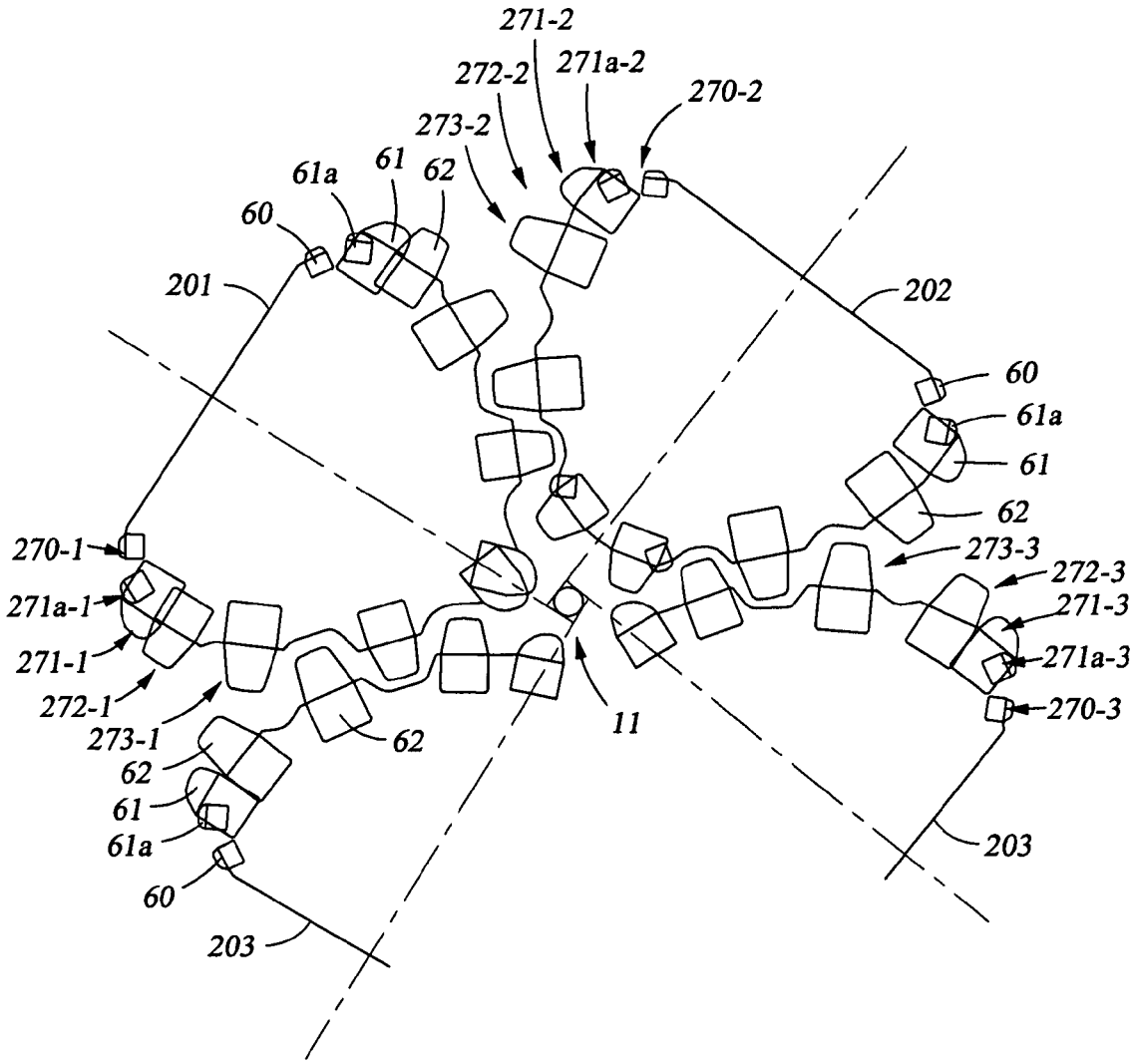
FIG. 19 is a cluster view showing, in rotated profile, the intermesh of the cutting elements of the drill bit shown in FIG. 18.

Referring now to FIGS. 18 and 19, the composite rotated profile view and the cluster views, respectively, of cutting elements 60, 61*a*, 61, 62 of cones 201-203 of another embodiment of a bit 200 are illustrated. In this embodiment, each cone 201, 202, 203 comprises a heel row 270-1, 270-2, 270-3, respectively, of heel cutting elements 60, a nestled gage row 271*a*-1, 271*a*-2, 271*a*-3, respectively, of nestled gage cutting elements 61*a*, and a gage row 271-1, 271-2, 271-3, respectively, of gage cutting elements 61. Immediately adjacent gage rows 271-1, 271-2, 271-3, each cone 201, 202, 203 further includes a first inner row 272-1, 272-2, 272-3, respectively, of bottomhole cutting elements 62, and a second inner row 273-1, 273-2, 273-3, respectively, of bottomhole cutting elements 62, respectively.

In this embodiment, cutting elements 62 in first inner row 272-1, 272-2, 272-3 are staggered relative to cutting elements 61 of gage row 271-1, 271-2, 271-3, respectively. In addition, the profiles of cutting elements 62 in first inner row 272-1, 272-3 at least partially overlap with the profiles of cutting elements 61 of gage row 271-1, 271-3, respectively. However, in this embodiment, the profiles of cutting elements 62 in first inner row 272-2 do not overlap with the profiles of cutting elements 61 of gage row 271-2 on cone 202. Further, cutting elements 62 in second inner row 273-1 are staggered relative to cutting elements 62 in first inner row 272-1 on cone 201. However, in this embodiment, cutting elements 62 of second inner row 273-2, 273-3 are unstaggered relative to cutting elements 62 in first inner row 272-2, 272-3, respectively. Thus, second inner row 273-2, 273-3 may have an independent count of cutting elements 62. Moreover, the profiles of cutting elements 62 in second inner row 273-1, 273-2, 273-3 do not overlap with the profiles of cutting elements 62 in first inner row 272-1, 272-2, 272-3, respectively.

The staggering of gage row 271-1, 271-2, 271-3 with first inner row 272-1, 272-2, 272-3, respectively, and the overlapping of gage row 271-1, 271-3 with first inner row 272-1, 272-3, offers the potential for an increased number of cutting elements 62, and associated insert density, in the drive zone as compared to most conventional bits of similar size. In addition, the staggering of first inner row 272-1 with second inner row 273-1 further enables an increase in the number of cutting elements 62, and associated insert density, in the drive zone as compared to most conventional bits of similar size. Embodiments of bit 200 are preferably designed for an IADC classification of 41*x* to 83*x*, and more preferably 41*x* to 42*x*. Thus, bottomhole cutting elements 62 of bit 200 each preferably have an extension height to diameter ratio between 0.25 and 1.04, and more preferably have an extension height to diameter ratio between 0.62 and 1.04.

Figure 20:
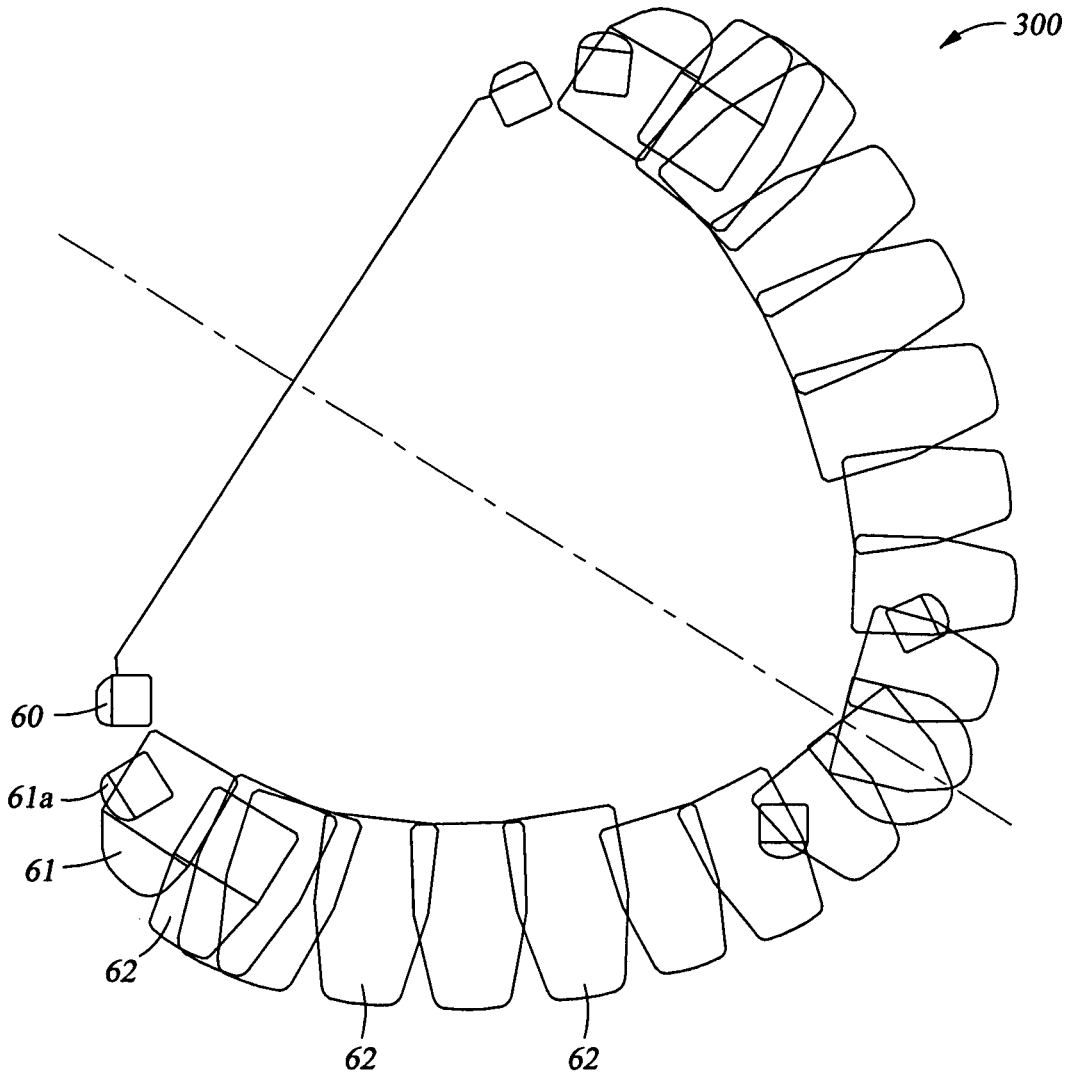
FIG. 20 is a schematic view showing, in composite rotated profile, the profiles of all of the cutting elements of the three cone cutters of an embodiment of an earth-boring bit made in accordance with the principles described herein.
Figure 21:
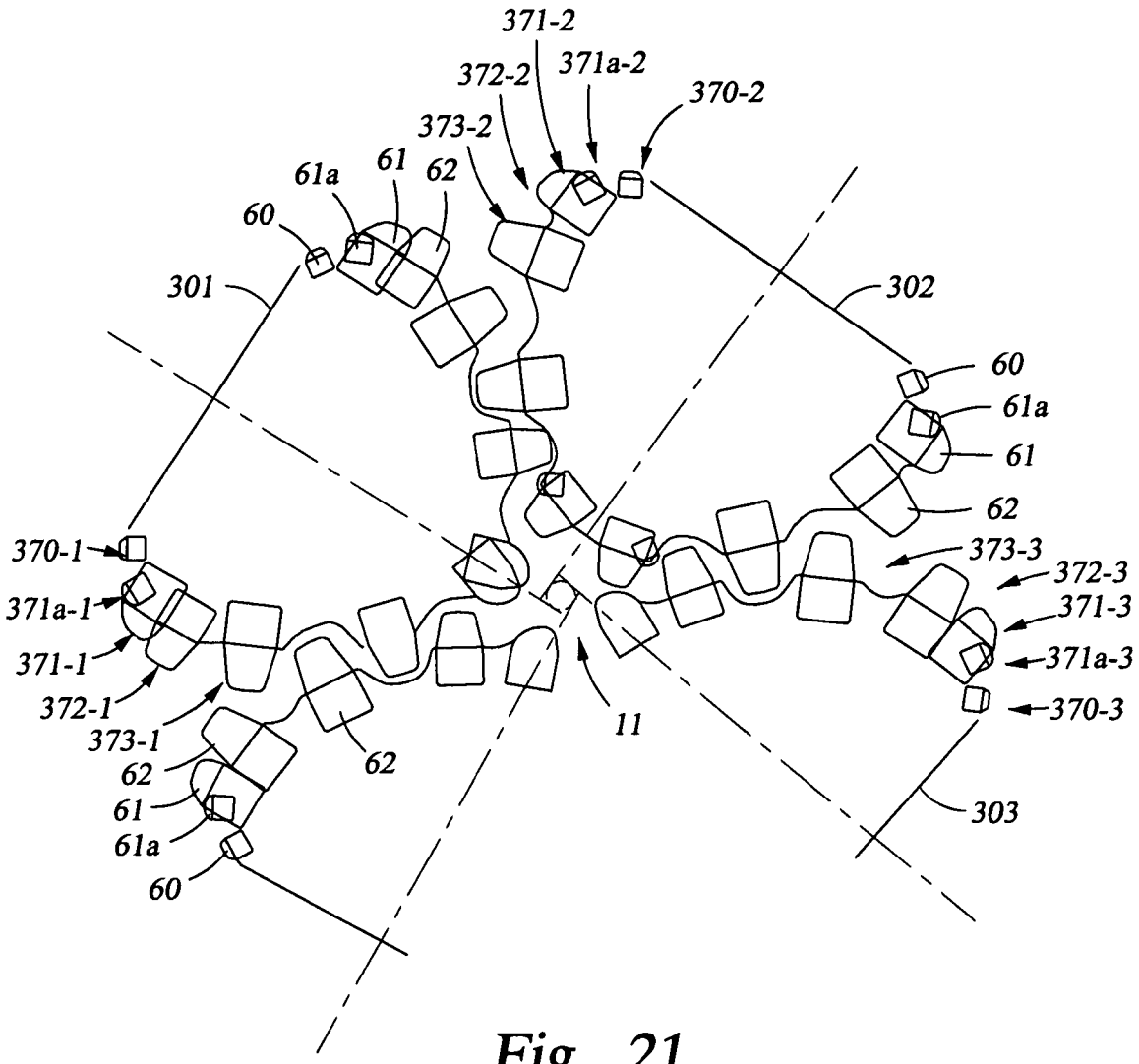
FIG. 21 is a cluster view showing, in rotated profile, the intermesh of the cutting elements of the drill bit shown in FIG. 20.

Referring now to FIGS. 20 and 21, the composite rotated profile view and the cluster views, respectively, of cutting elements 60, 61*a*, 61, 62 of cones 301-303 of another embodiment of a bit 300 are illustrated. In this embodiment, each cone 301, 302, 303 comprises a heel row 370-1, 370-2, 370-3, respectively, of heel cutting elements 60, a nestled gage row 371*a*-1, 371*a*-2, 371*a*-3, respectively, of nestled gage cutting elements 61*a*, and a gage row 371-1, 371-2, 371-3, respectively, of gage cutting elements 61. Immediately adjacent gage rows 371-1, 371-2, 371-3, each cone 301, 302, 303 further includes a first inner row 372-1, 372-2, 372-3, respectively, of bottomhole cutting elements 62, and a second inner row 373-1, 373-2, 373-3, respectively, of bottomhole cutting elements 62, respectively.

In this embodiment, cutting elements 62 in first inner row 372-1, 372-3 are staggered relative to cutting elements 61 of gage row 371-1, 371-3, respectively. However, cutting elements 62 in first inner row 372-2 are unstaggered relative to cutting elements 61 of gage row 371-2, and therefore, may have an independent count of cutting elements 62. In addition, the profiles of cutting elements 62 in first inner row 372-1, 372-3 at least partially overlap with the profiles of cutting elements 61 of gage row 371-1, 371-3, respectively. However, the profiles of cutting elements 62 in first inner row 372-2 do not overlap with the profiles of cutting elements 61 of gage row 371-2 on cone 302. Further, cutting elements 62 in second inner row 373-1, 373-2, 373-3 are unstaggered relative to cutting elements 62 in first inner row 372-1, 372-2, 372-3, respectively, and therefore, may each have an independent count of cutting elements 62. Moreover, the profiles of cutting elements 62 in second inner row 373-1, 373-2, 373-3 do not overlap with the profiles of cutting elements 62 in first inner row 372-1, 372-2, 372-3, respectively.

The staggering and overlapping of gage row 371-1, 371-3 with first inner row 372-1, 372-3, respectively, offers the potential for an increased number of cutting elements 62, and associated insert density, in the drive zone as compared to most conventional bits of similar size. Embodiments of bit 300 are preferably designed for an IADC classification of 41*x* to 83*x*, and more preferably 41*x* to 42*x*. Thus, bottomhole cutting elements 62 of bit 300 each preferably have an extension height to diameter ratio between 0.25 and 1.04, and more preferably have an extension height to diameter ratio between 0.62 and 1.04.

Figure 22:
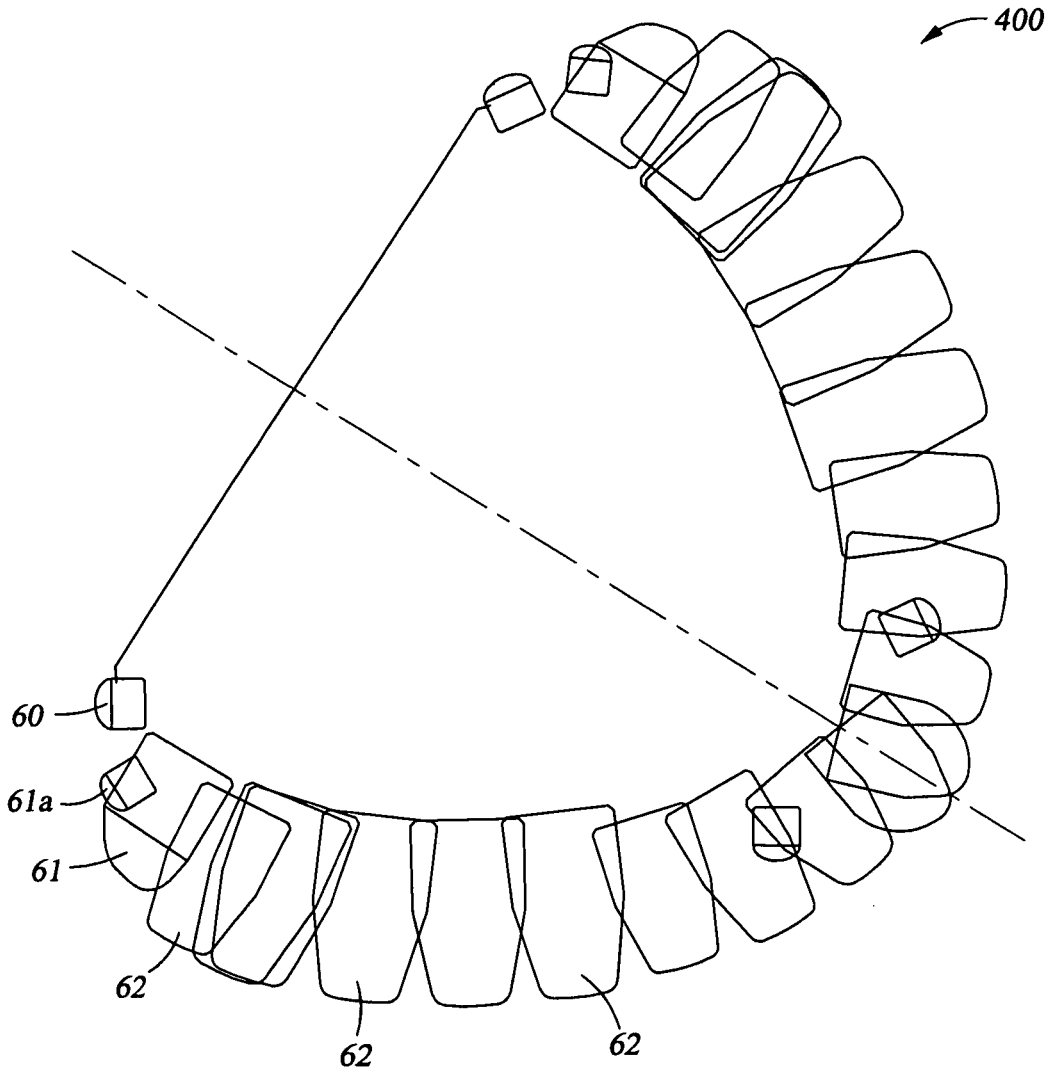
FIG. 22 is a schematic view showing, in composite rotated profile, the profiles of all of the cutting elements of the three cone cutters of an embodiment of an earth-boring bit made in accordance with the principles described herein.
Figure 23:
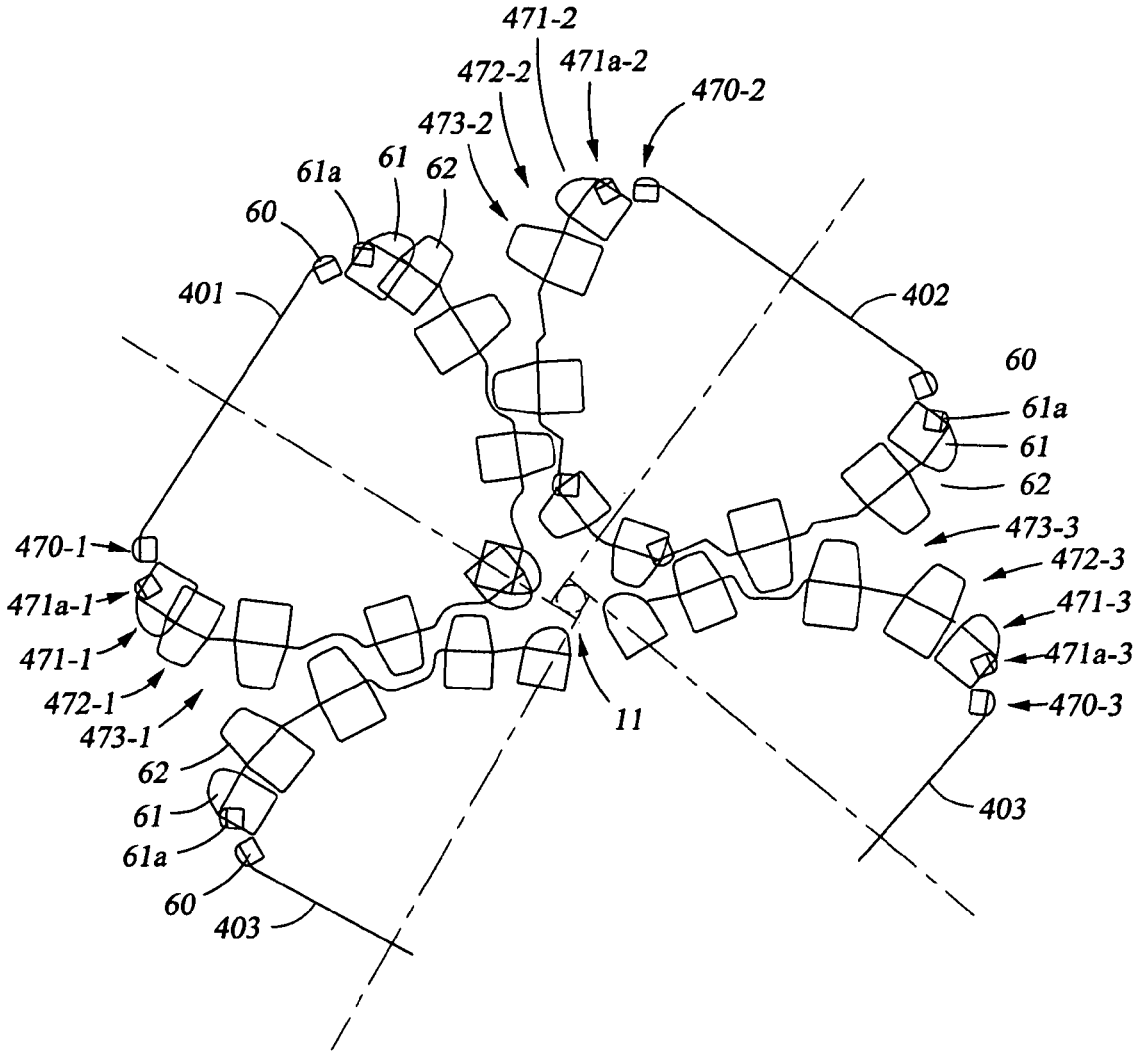
FIG. 23 is a cluster view showing, in rotated profile, the intermesh of the cutting elements of the drill bit shown in FIG. 22.

Referring now to FIGS. 22 and 23, the composite rotated profile view and the cluster views, respectively, of cutting elements 60, 61*a*, 61, 62 of cones 401-403 of another embodiment of a bit 400 are illustrated. In this embodiment, each cone 401, 402, 403 comprises a heel row 470-1, 470-2, 470-3, respectively, of heel cutting elements 60, a nestled gage row 471*a*-1, 471*a*-2, 471*a*-3, respectively, of nestled gage cutting elements 61*a*, and a gage row 471-1, 471-2, 471-3, respectively, of gage cutting elements 61. Immediately adjacent gage rows 471-1, 471-2, 471-3, each cone 401, 402, 403 further includes a first inner row 472-1, 472-2, 472-3, respectively, of bottomhole cutting elements 62, and a second inner row 473-1, 473-2, 473-3, respectively, of bottomhole cutting elements 62, respectively.

In this embodiment, cutting elements 62 in first inner row 472-1 are staggered relative to cutting elements 61 of gage row 471-1. However, cutting elements 62 in first inner row 472-2, 472-3 are unstaggered relative to cutting elements 61 of gage row 471-2, 471-3, respectively, and therefore, may have an independent count of cutting elements 62. In addition, the profiles of cutting elements 62 in first inner row 472-1 at least partially overlap with the profiles of cutting elements 61 of gage row 471-1. However, the profiles of cutting elements 62 in first inner row 472-2, 472-3 do not overlap with the profiles of cutting elements 61 of gage row 471-2, 471-3, respectively. Although cutting elements 62 in first inner row 472-2, 472-3 do not overlap with cutting elements 61 of gage row 471-2, 471-3, respectively, gage cutting elements 61 having a relatively smaller diameter may be employed to allow first inner row 472-2 and/or first inner row 472-3 to be moved axially (relative to their respective cone axis) closer to the bit gage diameter.

Further, cutting elements 62 in second inner row 473-1, 473-2, 473-3 are unstaggered relative to cutting elements 62 in first inner row 472-1, 472-2, 472-3, respectively, and therefore, may each have an independent count of cutting elements 62. Moreover, the profiles of cutting elements 62 in second inner row 473-1, 473-2, 473-3 do not overlap with the profiles of cutting elements 62 in first inner row 472-1, 472-2, 472-3, respectively.

The staggering and overlapping of gage row 471-1 with first inner row 472-1 offers the potential for an increased number of cutting elements 62, and associated insert density, in the drive zone as compared to most conventional bits of similar size. Embodiments of bit 400 are preferably designed for an IADC classification of 41*x* to 83*x*, and more preferably 41*x* to 42*x*. Thus, bottomhole cutting elements 62 of bit 400 each preferably have an extension height to diameter ratio between 0.25 and 1.04, and more preferably have an extension height to diameter ratio between 0.62 and 1.04.

Figure 24:
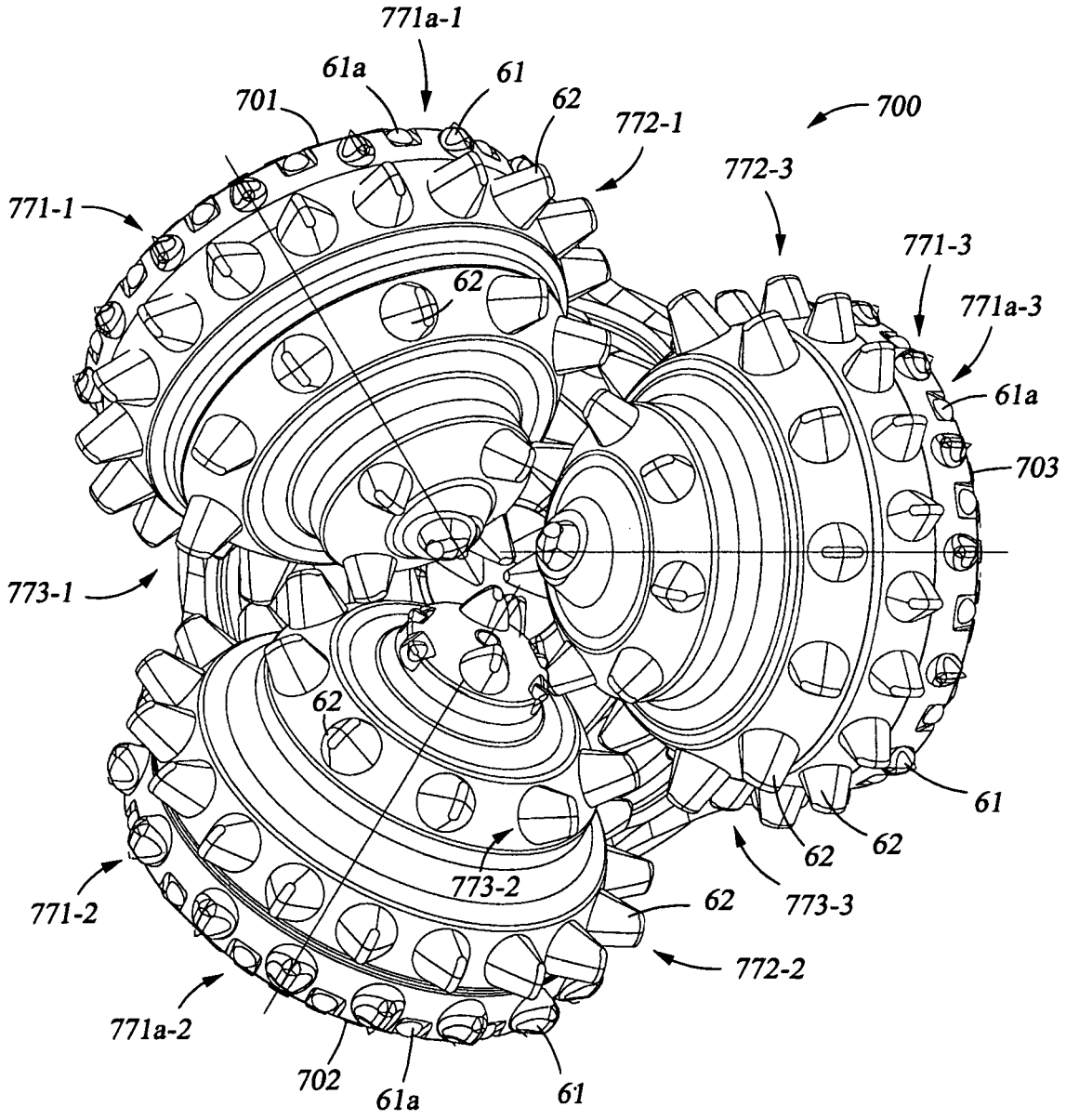
FIG. 24 is a bottom view of an earth-boring bit made in accordance with the principles described herein.

Referring now to FIG. 24, the bottom view of another embodiment of a bit 700 including cutting elements 60 (not shown), 61*a*, 61, 62 and cones 701-703 is illustrated. In this embodiment, each cone 701, 702, 703 comprises a heel row (not shown) of heel cutting elements 60, a nestled gage row 771*a*-1, 771*a*-2, 771*a*-3, respectively, of nestled gage cutting elements 61*a*, and a gage row 771-1, 771-2, 771-3, respectively, of gage cutting elements 61. Immediately adjacent gage rows 771-1, 771-2, 771-3, each cone 701, 702, 703 further includes a first inner row 772-1, 772-2, 772-3, respectively, of bottomhole cutting elements 62, and a second inner row 773-1, 773-2, 773-3, respectively, of bottomhole cutting elements 62, respectively.

In this embodiment, the cutting profiles of cutting elements 62 in first inner row 772-1, 772-2, 772-3 do not overlap with cutting profiles of cutting elements 61 of gage row 771-1, 771-2, 771-3, respectively. Rather, in this embodiment, gage cutting elements 61 are sized such that there is no overlap of the cutting profiles of any of cutting elements 61 and cutting elements 62 in rotated profile. Since cutting elements 62 in first inner row 772-1, 772-2, 772-3 do not overlap with cutting profiles of cutting elements 61 of gage row 771-1, 771-2, 771-3, respectively, one or more bottomhole cutting elements 62 in first inner row 772-1, 772-2, 772-3 may be unstaggered relative to gage cutting elements 61 in gage row 771-1, 771-2, 771-3, respectively, and thus, have an independent count of cutting elements 62. Indeed, in this embodiment, a set of bottomhole cutting elements 62 in first inner row 772-1 are unstaggered relative to gage cutting elements 61 in gage row 771-1, a set of bottomhole cutting elements 62 in first inner row 772-2 are unstaggered relative to gage cutting elements 61 in gage row 771-2, and a set of bottomhole cutting elements 62 in first inner row 772-3 are unstaggered relative to gage cutting elements 61 in gage row 771-3. In other words, in this embodiment, select bottomhole cutting elements 62 in first inner row 772-1 are azimuthally aligned with a corresponding gage cutting element 61 in gage row 771-1, select bottomhole cutting elements 62 in first inner row 772-2 are azimuthally aligned with a corresponding gage cutting element 61 in gage row 771-2, and select bottomhole cutting elements 62 in first inner row 772-3 are azimuthally aligned with a gage cutting element 61 in gage row 771-3. In addition, in this embodiment, a set of bottomhole cutting elements 62 in second inner row 773-3 are unstaggered relative to bottomhole cutting elements 62 in first inner row 772-3, and further, the cutting profiles of bottomhole cutting elements 62 in second inner row 773-3 do not overlap with the cutting profiles of bottomhole cutting elements 62 in second inner row 773-3.

In accordance with the principles disclosed herein, staggering and optionally overlapping of the first and second inner rows with respect to the gage row on at least two cones of a three cone rolling cone drill bit enables significant increases in insert density within the drive zone of the affected cones. The first inner row may include ½ to 1 times as many inserts as the number of inserts in the adjacent gage row. Similarly, the second inner row may include ½ to 1 times as many inserts as the number of inserts in the adjacent first inner row. Thus, in accordance with embodiments disclosed herein, the drive zone insert density for a bit may be significantly increased over that of conventional drill bits, perhaps by 60% or more. Such significant increases in the drive zone insert density may result in correspondingly significant increases in ROP and drill bit life.

In the embodiments previously described (e.g.,. bits 10, 100, 200, etc.), staggering and/or overlapping one or more rows of cutting elements (e.g., cutting elements 62) in the drive zone (e.g., drive zone 81) offers the potential for an increase in the total insert or cutting element count in drive zone as compared to similarly sized conventional bits. The degree or amount of increase of cutting elements in the drive zone may be described in terms of an "inner zone-to-drive zone insert ratio". As used herein, the phrase "inner zone-to-drive zone insert ratio" refers to the ratio of the number of bottomhole cutting elements (e.g., cutting elements 62) in the inner zone (e.g., inner zone 82) to the number of bottomhole cutting elements in the drive zone (e.g., drive zone 81).

Figure 25:
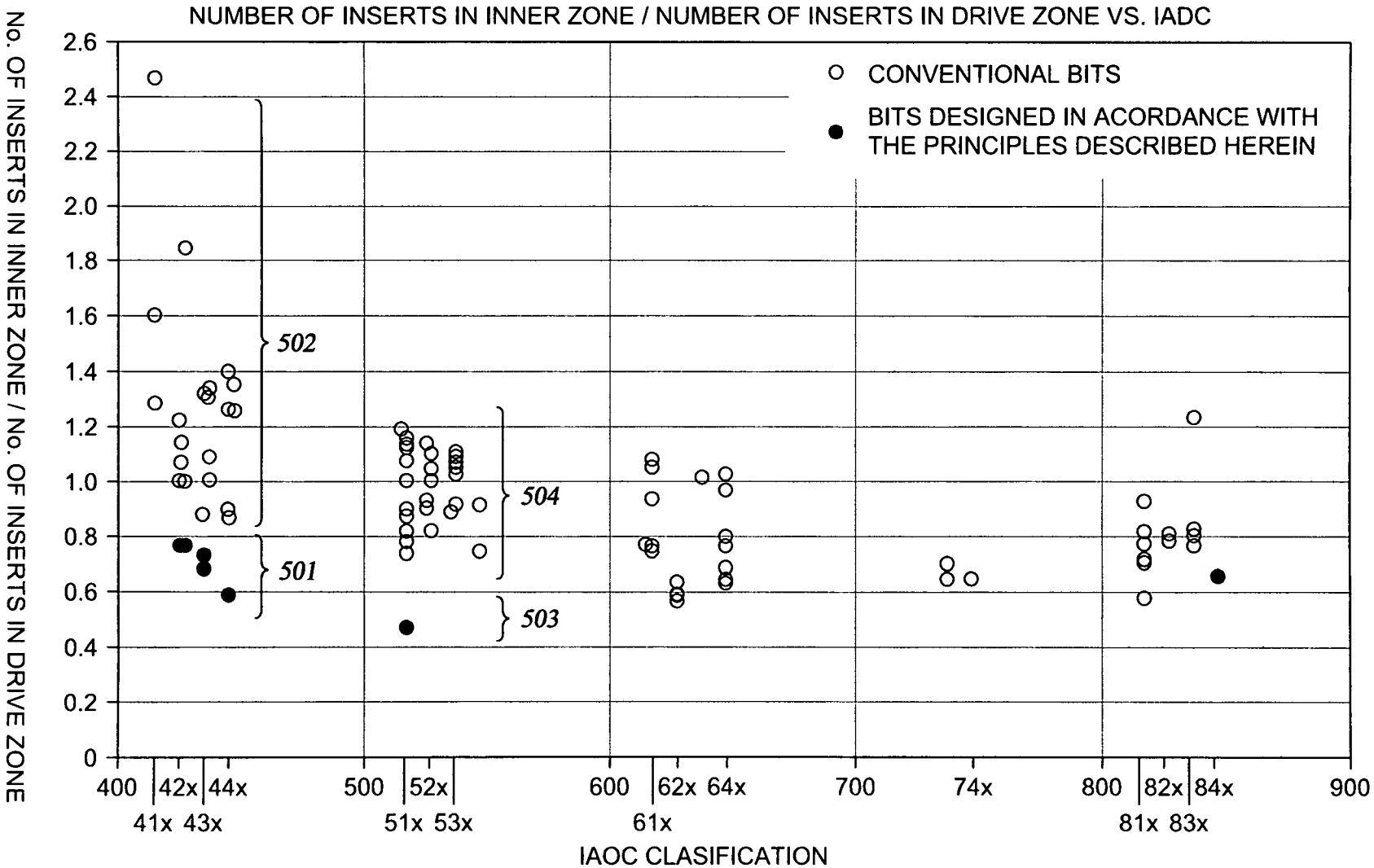
FIG. 25 is a graphical comparison of several bits designed in accordance with the principles described herein and a variety of conventional bits.

Referring now to FIG. 25, the inner zone-to-drive zone insert ratio for embodiments of bits designed in accordance with the principles described herein are graphically plotted as a function of their IADC classification. For comparison purposes, the inner zone-to-drive zone insert ratio for a variety of conventional bits are also graphically plotted as a function of their IADC classification. Without being limited by this or any particular theory, in general, a smaller inner zone-to-drive zone insert ratio indicates of an increased percentage, or increased count, of cutting elements in the drive zone relative to the inner zone. Whereas a larger inner zone-to-drive zone insert ratio indicates of an decreased percentage, or decreased count, of cutting elements in the drive zone relative to the inner zone.

Due to the staggering and/or overlapping of cutting elements in the drive zone, embodiments described herein offer the potential for an increased number of cutting elements in the drive zone, and hence a lower inner zone-to-drive zone insert ratio, as compared to conventional bits of similar IADC classification. As shown in FIG. 25, for a given IADC Series (e.g., IADC Series 4, IADC Series 5, IADC Series 6, IADC Series 7, or IADC Series 8), or for a specific IADC classification (e.g., 42*x*), the inner zone-to-drive zone insert ratio for embodiments designed in accordance with the principles described herein is less than the inner zone-to-drive zone insert ratio for conventional bits. For instance, for IADC Series 4 (i.e., IADC classifications 41*x* to 44*x*), bits 501 designed in accordance with the principles described herein have an inner zone-to-drive zone insert ratio less than about 0.84, whereas conventional bits 502 have an inner zone-to-drive zone insert ratio of 0.86 and above. As another example, for IADC Series 5 (i.e., IADC classifications 51*x* to 54*x*), bits 503 designed in accordance with the principles described herein have an inner zone-to-drive zone insert ratio less than about 0.70, whereas conventional bits 504 have an inner zone-to-drive zone insert ratio greater than 0.70. For IADC Series 6 (i.e., IADC classifications 61*x* to 64*x*), IADC Series 7 (i.e., IADC classifications 71*x* to 74*x*), and IADC Series 8 (i.e., IADC classifications 81*x* to 84*x*) bits designed in accordance with the principles described herein have an inner zone-to-drive zone insert ratio less than about 0.56, 0.64, and 0.56, respectively. As summarized in Table 3 below, IADC Series 4 drill bits designed in accordance with the principles described herein preferably have an inner zone-to-drive zone insert ratio less than or equal to about 0.84, and more preferably less than 0.76; IADC Series 5 drill bits designed in accordance with the principles described herein preferably have an inner zone-to-drive zone insert ratio less than or equal to about 0.70, and more preferably less than 0.63; and IADC Series 6, 7, and 8 drill bits designed in accordance with the principles described herein preferably have an inner zone-to-drive zone insert ratio less than or equal to about 0.56, and more preferably less than 0.50.

TABLE 3

Preferred Inner Zone-to-Drive Zone Insert Ratio

| IADC Series | Preferred Inner Zone-to-Drive Zone Insert Ratio | More Preferred Inner Zone-to-Drive Zone Insert Ratio |
|---|---|---|
| 4 | 0.84 | 0.76 |
| 5 | 0.70 | 0.63 |
| 6-8 | 0.56 | 0.50 |

Figure 26:
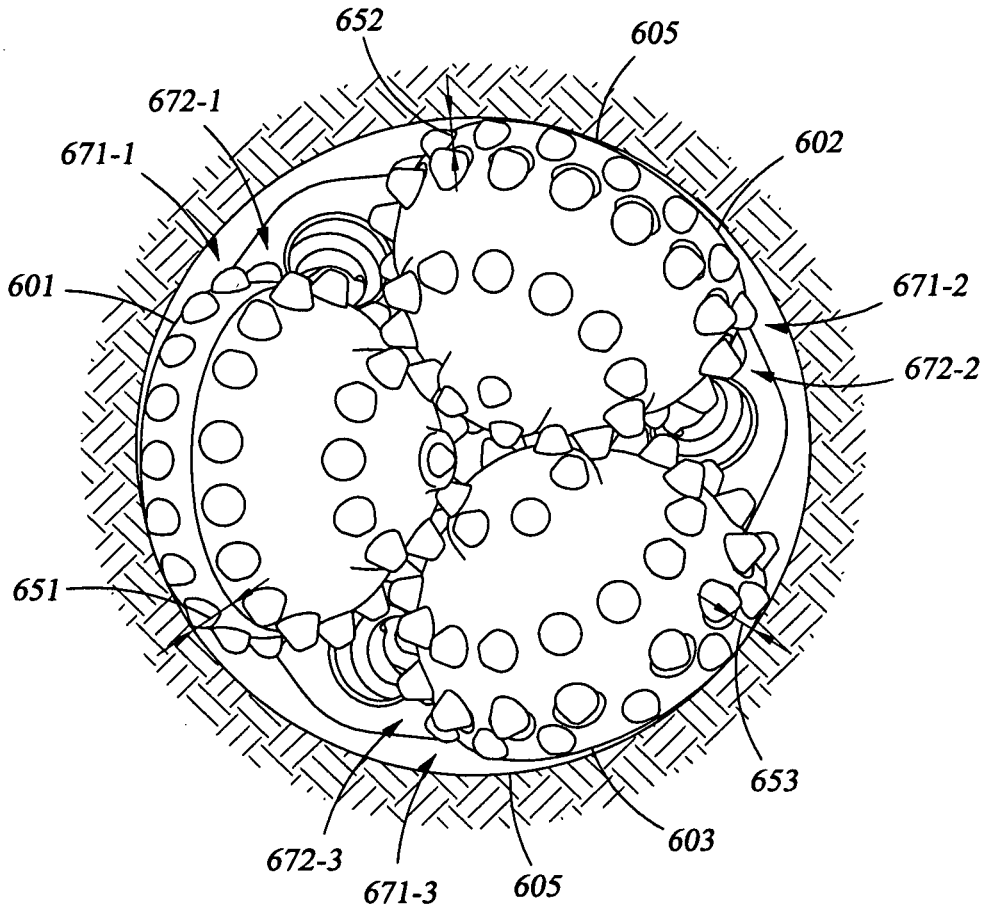
FIG. 26 is a bottom schematic view of an earth-boring bit designed in accordance with the principles described herein.

By staggering and/or overlapping the first inner row rows of cutting elements (e.g., cutting elements 62) positioned in the drive zone (e.g., drive zone 81) with the gage row of cutting elements (e.g., cutting elements 61) in the gage zone of the same cone, embodiments described herein allow for the first inner row of cutting elements to be moved axially (relative to the cone axis) closer to the full gage diameter of the bit as compared to many conventional bits. For instance, referring to FIG. 26, a bottom view of a bit 600 designed in accordance with principles described herein is shown. Bit 600 includes three cones 601, 602, 603 comprising a gage row 671-1, 671-2, 671-3, respectively, of gage cutting elements 61, and a first inner row 672-1, 672-2, 672-3, respectively, of bottomhole cutting elements 62. The outermost reaches of the cutting elements (e.g., cutting elements 61, 62) of bit 600 define the full gage diameter of bit 60 represented by gage ring 605. First inner row 672-1 of cone 601 has a minimum radial offset 651 from full gage diameter measured perpendicularly from gage ring 605 to cutting elements 62 of first inner row 672-1 at their closest pass to gage ring 605. Likewise, first inner row 672-2 of cone 602 has a minimum radial offset 652 from full gage diameter measured perpendicularly from gage ring 605 to cutting elements 62 of first inner row 672-2 at their closest pass to gage ring 605; and first inner row 672-3 of cone 603 has a minimum radial offset 653 from full gage diameter measured perpendicularly from gage ring 605 to cutting elements 62 of first inner row 672-3 at their closest pass to gage ring 605. In this embodiment, minimum radial offset 651 is greater than minimum radial offset 653, and minimum radial offset 653 is greater than minimum radial offset 652. As used herein, the phrase "max of the first inner row minimum offsets" refers to the largest of all the minimum radial offsets of the first inner rows among the plurality of cones on a bit, and the phrase "min of the first inner row minimum offsets" refers to the smallest of all the minimum radial offsets of the first inner rows among the plurality of cones on a bit first row offset. Thus, for bit 600 previously described, minimum radial offset 651 is the max of the first inner row minimum offsets since it is greater than both minimum radial offset 652 of cone 602 and minimum radial offset 653 of cone 603, and minimum radial offset 653 is the min of the first inner row minimum offsets since it is less than both minimum radial offset 651 of cone 601 and minimum radial offset 652 of cone 602.

As compared to similarly sized conventional bits, embodiments described herein (e.g., bit 600) offer the potential to reduce minimum distances from gage of the first inner row cutting elements of each cone. The degree to which cutting elements of the first inner row are moved closer to full gage diameter may be quantified by comparing the radial offsets of the first inner rows for embodiments designed in accordance with the principles described herein to the radial offsets of the first inner rows of conventional bits. To account for differences in bit sizes and cutting element sizes, the radial offsets of the first inner rows may be characterized by a "normalized radial offset" calculated by subtracting the min of the first inner row minimum offsets from the max of the first inner row minimum offsets, and then dividing the difference by the diameter of the first inner row inserts as follows:

Normalized radial offset=[(max of the first inner row minimum offsets)−(min of the first inner row minimum offsets)]/(diameter of the first inner row inserts)

Without being limited by this or any particular theory, in general, a smaller normalized radial offset indicates first inner rows of cutting elements that are relatively closer to full gage diameter and the borehole sidewall. Whereas a larger normalized radial offset indicates first inner rows of cutting elements that are relatively further from full gage diameter and the borehole sidewall.

Figure 27:
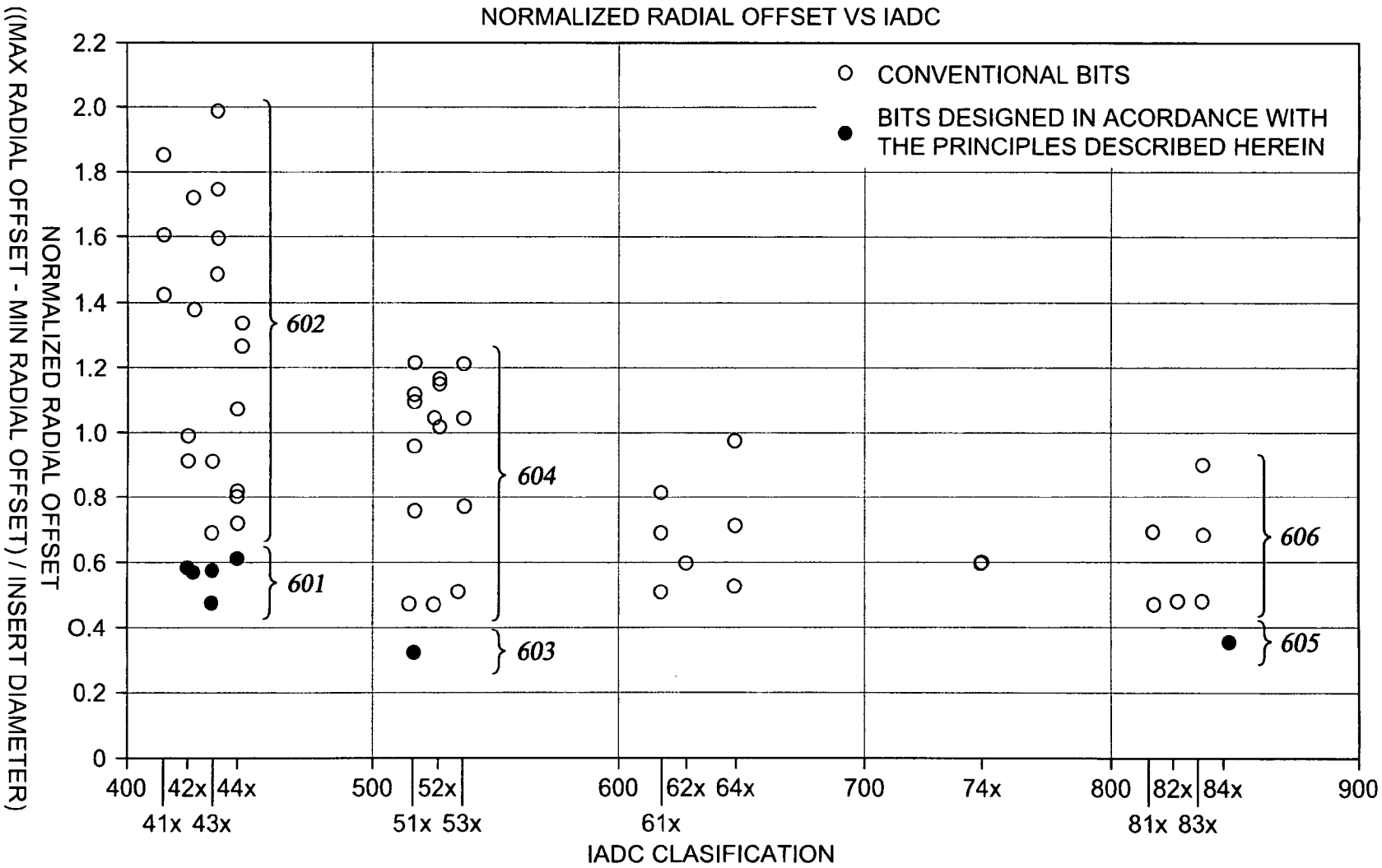
FIG. 27 is a graphical comparison of several bits designed in accordance with the principles described herein and a variety of conventional bits.

Referring now to FIG. 27, the normalized radial offset for embodiments of exemplary bits designed in accordance with the principles described herein are graphically plotted as a function of their IADC classification. For comparison purposes, the normalized radial offsets for a variety of conventional bits are also graphically plotted as a function of their IADC classification.

Due to the staggering and/or overlapping of cutting elements in the drive zone, embodiments described herein offer the potential for a decreased normalized radial offset as compared to conventional bits of similar IADC classification. As shown in FIG. 27, for a given IADC Series (e.g., IADC Series 4, IADC Series 5, IADC Series 6, IADC Series 7, or IADC Series 8), or for a specific IADC classification (e.g., 42*x*), the normalized radial offset for embodiments designed in accordance with the principles described herein is less than the normalized radial offset for conventional bits. For instance, for IADC Series 4 (i.e., IADC classifications 41$x$ to 44$x$), bits 601 designed in accordance with the principles described herein have a normalized radial offset less than or equal to about 0.640, whereas conventional bits 602 have a normalized radial offset greater than 0.680. As another example, for IADC Series 5 (i.e., IADC classifications 51$x$ to 54$x$), bits 603 designed in accordance with the principles described herein have a normalized radial offset less than about 0.440, whereas conventional bits 604 have a normalized radial offset greater than 0.440. As still yet another example, for IADC Series 8 (i.e., IADC classifications 81$x$ to 84$x$), bits 605 designed in accordance with the principles described herein have a normalized radial offset less than about 0.440, whereas conventional bits 606 have a normalized radial offset greater than 0.440. In particular, as summarized in Table 4 below, IADC Series 4 (i.e., IADC classifications 41$x$ to 44$x$) drill bit designed in accordance with the principles described herein preferably have a normalized radial offset less than or equal to about 0.640, and more preferably less than 0.58; and IADC Series 5-8 (i.e., IADC classifications 51$x$ to 83$x$) drill bit designed in accordance with the principles described herein preferably have a normalized radial offset less than or equal to about 0.43, and more preferably less than 0.39.

TABLE 4

| Preferred Normalized Radial Offset | | |
|---|---|---|
| IADC Series | Preferred Normalized Radial Offset | More Preferred Normalized Radial Offset |
| 4 | less than 0.64 | less than 0.58 |
| 5-8 | less than 0.43 | less than 0.39 |

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A rolling cone drill bit for drilling a borehole in earthen formations, the bit comprising:

a bit body having a bit axis;

a plurality of rolling cone cutters mounted on the bit body for rotation about a cone axis;

wherein each cone cutter includes a plurality of gage cutting elements mounted in a gage zone, a first plurality of bottomhole cutting elements mounted in a drive zone, and a second plurality of bottomhole cutting elements mounted in an inner zone, wherein at least some of the first plurality of bottomhole cutting elements mounted in the inner zone of one of said plurality of rolling cone cutters mesh with at least some of the first plurality of bottomhole cutting elements mounted in the inner zone of another of said plurality of rolling cone cutters;

wherein the drill bit has an IADC classification selected from the group of IADC classifications between 41$x$ and 84$x$, wherein the ratio of the total number of bottomhole cutter elements in the inner zone on all three cones to the total number of bottomhole cutter elements in the drive zone of all three cones is less than:

0.84 when the drill bit has an IADC classification between 41$x$ and 44$x$, 0.70 when the drill bit has an IADC classification between 51$x$ and 54$x$, and 0.56 when the drill bit has an IADC classification between 61$x$ and 83$x$.

2. The drill bit of claim 1, wherein the ratio of the total number of bottomhole cutter elements in the inner zone on all three cones to the total number of bottomhole cutter elements in the drive zone of all three cones is less than:

0.76 when the drill bit has an IADC classification between 41$x$ and 44$x$, 0.63 when the drill bit has an IADC classification between 51$x$ and 54$x$, and 0.50 when the drill bit has an IADC classification between 61$x$ and 83$x$.

3. The drill bit of claim 1, wherein the drill bit has a full gage radius, an inner zone extending from the bit axis to about 70% of the full gage radius, a drive zone extending from the inner zone to about 95% of the full gage radius, and a gage zone extending from the drive zone to the full gage radius.

4. The drill bit of claim 1, wherein the plurality of gage cutting elements on each cone are arranged in a circumferential gage row;

wherein the first plurality of bottomhole cutting elements on each cone are arranged in a first inner row axially adjacent to the gage row relative to the cone axis; and wherein each bottomhole cutting element of the first inner row is staggered relative to the gage cutting elements of the gage row on at least one cone cutter.

5. The drill bit of claim 4, wherein the profiles of the gage cutting elements of the gage row and the bottomhole cutting elements of the first inner row on at least one cone cutter overlap in a rotated profile view.

6. The drill bit of claim 1, wherein the plurality of gage cutting elements on each cone are arranged in a circumferential gage row;

wherein the first plurality of bottomhole cutting elements on each cone are arranged in a first inner row axially adjacent the gage row relative to the cone axis; and wherein each bottomhole cutting element of the first inner row is staggered relative to the gage cutting elements of the gage row on at least two cone cutters.

7. The drill bit of claim 6, wherein the profiles of the gage cutting elements of the gage row and the bottomhole cutting elements of the first inner row on at least two cone cutters overlap in a rotated profile view.

8. The drill bit of claim 1, wherein the plurality of gage cutting elements on each cone are arranged in a circumferential gage row;

wherein the first plurality of bottomhole cutting elements on each cone are arranged in a first inner row axially adjacent the gage row relative to the cone axis; and wherein each bottomhole cutting element of the first inner row is staggered relative to the gage cutting elements of the gage row on each cone cutter.

9. The drill bit of claim 8, wherein the profiles of the gage cutting elements of the gage row and the bottomhole cutting elements of the first inner row on each cone cutters overlap in a rotated profile view.

10. The drill bit of claim 1, wherein at least one of the second plurality of bottomhole cutting elements comprises a cutting element axis, a base portion having a diameter, and a cutting portion extending from the base portion to a point furthermost from the base portion defining an extension height, wherein the ratio of the extension height to the base portion diameter of the at least one of the second plurality of bottomhole cutting element is:

between 0.60 and 1.00 when the drill bit has an IADC classification between 41$x$and 44$x$; and between 0.50 and 0.80 when the drill bit has an IADC classification between 51$x$and 54$x$.

11. The drill bit of claim 10, wherein the ratio of the extension height to the base portion diameter of the at least one of the second plurality of bottomhole cutting elements is:

between 0.80 and 1.00 when the drill bit has an IADC classification between 41$x$and 44$x$; and between 0.60 and 0.80 when the drill bit has an IADC classification between 51$x$and 54$x$.

12. The drill bit of claim 10, wherein the plurality of gage cutting elements on each cone are arranged in a circumferential gage row;

wherein the first plurality of bottomhole cutting elements on each cone are arranged in a first inner row axially adjacent to the gage row relative to the cone axis; and wherein each bottomhole cutting element of the first inner row is staggered relative to the gage cutting elements of the gage row on at least one cone; and wherein the profiles of the gage cutting elements of the gage row and the bottomhole cutting elements of the first inner row on at least one cone cutter overlap in a rotated profile view.

13. The drill bit of claim 10, wherein the plurality of gage cutting elements on each cone are arranged in a circumferential gage row;

wherein the first plurality of bottomhole cutting elements on each cone are arranged in a first inner row axially adjacent the gage row relative to the cone axis; and wherein each bottomhole cutting elements of the first inner row is staggered relative to the gage cutting elements of the gage row on at least two cone cutters; and wherein the profiles of the gage cutting elements of the gage row and the bottomhole cutting elements of the first inner row on at least two cone cutters overlap in a rotated profile view.

14. The drill bit of claim 1, wherein at least one cone cutter includes a third plurality of bottomhole cutting elements mounted in the drive zone, and wherein at least one of the third plurality of bottomhole cutting elements comprises a cutting element axis, a base portion having a diameter, and a cutting portion extending from the base portion to a point furthermost from the base portion defining an extension height;

wherein the ratio of the extension height to the base portion diameter of the at least one of the third plurality of bottomhole cutting elements is:

between 0.60 and 1.00, when the drill bit has an IADC classification between 41$x$and 44$x$; and between 0.50 and 0.80 , when the drill bit has an IADC classification between 51$x$and 54$x$.

15. The drill bit of claim 1, wherein the bit has a normalized radial offset less than:

0.64 when the drill bit has an IADC classification between 41$x$ and 44$x$, and 0.43 when the drill bit has an IADC classification between 51$x$ and 84$x$.

16. The drill bit of claim 15, wherein the bit has a normalized radial offset less than:

0.58 when the drill bit has an IADC classification between 41$x$ and 44$x$, and 0.39 when the drill bit has an IADC classification between 51$x$ and 84$x$.

17. The drill bit of claim 1, wherein each cone cutter has a positive cone offset.

18. The drill bit of claim 17, wherein each cone cutter has a positive offset greater than:

0.219 in. when the drill bit has a full gage diameter less than 9.875 in.; and 0.375 when the drill bit has a full gage diameter greater than or equal to 9.875 in.

19. A rolling cone drill bit for drilling a borehole in earthen formations and defining a full gage diameter, the bit comprising:

a bit body having a bit axis;

a plurality of rolling cone cutters mounted on the bit body for rotation about a cone axis;

wherein each cone cutter includes a plurality of gage cutting elements mounted in a circumferential gage row, a first plurality of bottomhole cutting elements mounted in a first circumferential inner row axially adjacent the gage row relative to the cone axis, wherein the drill bit has an IADC classification selected from the group of IADC classification between 41$x$and 84$x$; and wherein the bit has a normalized radial offset less than:

0.64 when the drill bit has an IADC classification between 41$x$ and 44$x$; and 0.43 when the drill bit has an IADC classification between 51$x$ and 84$x$.

20. The drill bit of claim 19, wherein the bit has a normalized radial offset less than:

0.58 when the drill bit has an IADC classification between 41$x$ and 44$x$; and 0.39 when the drill bit has an IADC classification between 51$x$ and 84$x$.

21. The drill bit of claim 19 wherein the plurality of gage cutting elements on each cone are arranged in a circumferential gage row;

wherein the first plurality of bottomhole cutting elements on each cone are arranged in a first inner row axially adjacent to the gage row relative to the cone axis;

wherein the second plurality of bottom hole cutting elements on each cone are arranged in a second inner row axially adjacent to the first row relative to the cone axis;

wherein each bottomhole cutting element of the first inner row is staggered relative to the gage cutting elements of the gage row on at least one cone cutter; and wherein the profiles of the gage cutting elements of the gage row and the bottomhole cutting elements of the first inner row on at least one cone cutter overlap in a rotated profile view.

22. The drill bit of claim 19, wherein the plurality of gage cutting elements on each cone are arranged in a circumferential gage row;

wherein the first plurality of bottomhole cutting elements on each cone are arranged in a first inner row axially adjacent the gage row relative to the cone axis; and wherein each bottomhole cutting element of the first inner row is staggered relative to the gage cutting elements of the gage row on at least two cone cutters; and wherein the profiles of the gage cutting elements of the gage row and the bottomhole cutting elements of the first inner row on at least two cone cutters overlap in a rotated profile view.

23. The drill bit of claim 19, wherein the plurality of gage cutting elements on each cone are arranged in a circumferential gage row;

wherein the first plurality of bottomhole cutting elements on each cone are arranged in a first inner row axially adjacent the gage row relative to the cone axis; and wherein each bottomhole cutting element of the first inner row is staggered relative to the gage cutting elements of the gage row on each cone cutter; and wherein the profiles of the gage cutting elements of the gage row and the bottomhole cutting elements of the first inner row on each cone cutter overlap in a rotated profile view.

* * * * *